US012496629B2

(12) United States Patent
Pena

(10) Patent No.: US 12,496,629 B2
(45) Date of Patent: Dec. 16, 2025

(54) TOOL FOR WIRE FORMING

(71) Applicant: CAES SYSTEMS LLC, Arlington, VA (US)

(72) Inventor: Brent Pena, San Diego, CA (US)

(73) Assignee: CAES Systems LLC, Arlington, VA (US)

( * ) Notice: Subject to any disclaimer, the term of this patent is extended or adjusted under 35 U.S.C. 154(b) by 302 days.

(21) Appl. No.: 18/147,447

(22) Filed: Dec. 28, 2022

(65) Prior Publication Data

US 2024/0216982 A1 Jul. 4, 2024

(51) Int. Cl.
*B21F 1/00* (2006.01)

(52) U.S. Cl.
CPC ..... *B21F 1/004* (2013.01)

(58) Field of Classification Search
CPC .. B21F 1/00; B21F 1/002; B21F 1/004; B21F 1/006; B21F 7/00; B21F 45/00
USPC ..... 140/71 C, 102.5, 123, 124, 149
See application file for complete search history.

(56) References Cited

U.S. PATENT DOCUMENTS 1,836,502 A * 12/1931 Poole ..... B21F 1/00 72/30.1
2,527,123 A * 10/1950 Ferdus ..... B21F 1/00 72/385
3,174,517 A * 3/1965 Wilson ..... B21D 11/06 140/123
3,227,194 A * 1/1966 Burke ..... H01G 13/006 140/123
3,229,727 A * 1/1966 Kenlon ..... B21F 1/06 140/123
3,244,202 A * 4/1966 Huang ..... H01R 43/033 242/439.1
4,037,629 A * 7/1977 Hively ..... B21D 13/04 72/196
4,421,145 A * 12/1983 Broberg, Jr. ..... B21F 45/00 140/123
7,703,482 B1 * 4/2010 Tiebout ..... B21F 1/002 140/123
9,032,775 B2 * 5/2015 Gupta ..... A44C 27/00 72/477

* cited by examiner

*Primary Examiner* — Edward T Tolan
(74) *Attorney, Agent, or Firm* — Alston & Bird LLP

(57) ABSTRACT

A tool for wire forming is provided. The tool for wire forming may include a first anvil having a first chamber. The tool for wire forming further includes a second anvil having a second chamber. The tool for wire forming further includes a mandrel having a first portion disposed in the first chamber, a second portion disposed in the second chamber, and a third portion in between the first portion and the second portion. The third portion may include a recess configured to receive a wire. The second anvil may be configured to be actuated from an open position to a closed position to transform the wire into a formed wire.

11 Claims, 22 Drawing Sheets

TOOL FOR WIRE FORMING

FIELD

Example, embodiments of the present disclosure relate generally to a tool for wire forming, such as for high production and consistent production wire forming, and associated methods.

BACKGROUND

Electrical connectors, such as wires, are used in numerous electrical systems to provide electrical connection between components of the electrical system and/or other electrical systems. In many electrical systems, it is necessary that the electrical connectors have a particular shape, to obtain particular electrical characteristics (e.g., the shape of the electrical connector may impact the electrical characteristics of the electrical connector) and/or fit into a particular physical space. One such electrical system includes channelizers in which a formed wire is needed to provide an electrical connection between an electrical trace and a resonator coil. For example, the formed wire in a channelizer may have a u-shaped portion and an elbow-shaped portion to obtain electrical connection between the electrical trace and the resonator coil.

An ability to produce electrical connectors having a particular shape, such as formed wires, in an efficient, consistent, and precise manner (e.g., precisely to specification), can ensure that the electrical connectors have the correct electrical characteristics and fit into the desired physical space. Conventional approaches for producing electrical connectors having a particular shape include technicians using calipers and microscopes to create the electrical connectors having a particular shape, which is time consuming, inconsistent, and imprecise. Accordingly, apparatuses and methods that can produce electrical connectors having a particular shape in an efficient, consistent, and precise manner, would be beneficial.

Through applied effort, ingenuity, and innovation, many of these identified problems have been solved by developing solutions that are included in embodiments of the present disclosure, many examples of which are described in detail herein.

BRIEF SUMMARY

Various embodiments described herein relate to a high production tool for wire forming and associated methods.

In accordance with one aspect of the disclosure, a tool for producing a formed wire is provided. In some embodiments, the tool for producing the formed wire may include a first anvil comprising a first chamber. In some embodiments, the tool for producing the formed wire may include a second anvil comprising a second chamber. In some embodiments, the tool for producing the formed wire may include a mandrel having a first portion disposed in the first chamber, a second portion disposed in the second chamber, and a third portion in between the first portion and the second portion. In some embodiments, the third portion comprises a recess configured to receive a wire. In some embodiments, the second anvil is configured to be actuated from an open position to a closed position to transform the wire into the formed wire.

In some embodiments, the tool for producing the formed wire may include a plate fixed to the first anvil and comprising a stopper proximate the third portion of the mandrel.

In some embodiments, the second anvil being configured to be actuated from the open position to the closed position comprises the second anvil being configured to be rotated and pushed towards the first anvil.

In some embodiments, the second anvil is configured to be rotated from a first position to a second position. In some embodiments, the second anvil is in contact with the stopper when in the second position.

In some embodiments, the second anvil is configured to be rotated from the first position to the second position to transform the wire into a curved wire.

In some embodiments, the second anvil is configured to be pushed to towards the first anvil to transform the curved wire into the formed wire.

In some embodiments, the formed wire comprises a u-shaped portion and an elbow-shaped portion.

In some embodiments, the curved wire comprises a u-shaped portion.

In accordance with another aspect of the disclosure, a method for producing a formed wire is provided. In some embodiments, the method for producing a formed wire may include placing a wire into a recess of a mandrel. In some embodiments, the mandrel has a first portion disposed in a first chamber of a first anvil, a second portion disposed in a second chamber of a second anvil, and a third portion in between the first portion and the second portion. In some embodiments, the method for producing a formed wire may include rotating the second anvil from a first position to a second position to transform the wire into a curved wire. In some embodiments, the method for producing a formed wire may include pushing the second anvil towards the first anvil to transform the curved wire into the formed wire.

In some embodiments, the method for producing a formed wire may include retracting the second anvil away from the first anvil.

In some embodiments, the method for producing a formed wire may include removing the formed wire from the recess of the mandrel.

In some embodiments, the second anvil is in contact with a stopper when in the second position.

In some embodiments, the formed wire comprises a u-shaped portion and an elbow-shaped portion.

In accordance with yet another aspect of the disclosure, a method of manufacturing a tool for producing a formed wire is provided. In some embodiments, the method may include providing a first anvil comprising a first chamber. In some embodiments, the method may include providing a second anvil comprising a second chamber. In some embodiments, the method may include providing a mandrel having a first portion disposed in the first chamber, a second portion disposed in the second chamber, and a third portion in between the first portion and the second portion. In some embodiments, the third portion comprises a recess configured to receive a wire. In some embodiments, the second anvil is configured to be actuated from an open position to a closed position to transform the wire into the formed wire.

In some embodiments, the method may include providing a plate fixed to the first anvil and comprising a stopper proximate the third portion of the mandrel.

In some embodiments, the second anvil being configured to be actuated from the open position to the closed position comprises the second anvil being configured to be rotated and pushed towards the first anvil.

In some embodiments, the second anvil is configured to be rotated from a first position to a second position. In some embodiments, the second anvil is in contact with the stopper when in the second position.

In some embodiments, the second anvil is configured to be rotated from the first position to the second position to transform the wire into a curved wire.

In some embodiments, the second anvil is configured to be pushed to towards the first anvil to transform the curved wire into the formed wire.

In some embodiments, the formed wire comprises a u-shaped portion and an elbow-shaped portion.

In some embodiments, the curved wire comprises a u-shaped portion.

The above summary is provided merely for purposes of summarizing some example embodiments to provide an understanding of aspects of the present disclosure. Accordingly, it will be appreciated that the above-described embodiments are merely examples and should not be construed to narrow the scope or spirit of the disclosure in any way. It will be appreciated that the scope of the present disclosure encompasses many potential embodiments in addition to those here summarized, some of which are further described below.

BRIEF DESCRIPTION OF THE DRAWINGS

Reference will now be made to the accompanying drawings. The components illustrated in the figures may or may not be present in certain embodiments described herein. Some embodiments may include fewer (or more) components than those shown in the figures in accordance with an example embodiment of the present disclosure.

DETAILED DESCRIPTION

Figure 1:
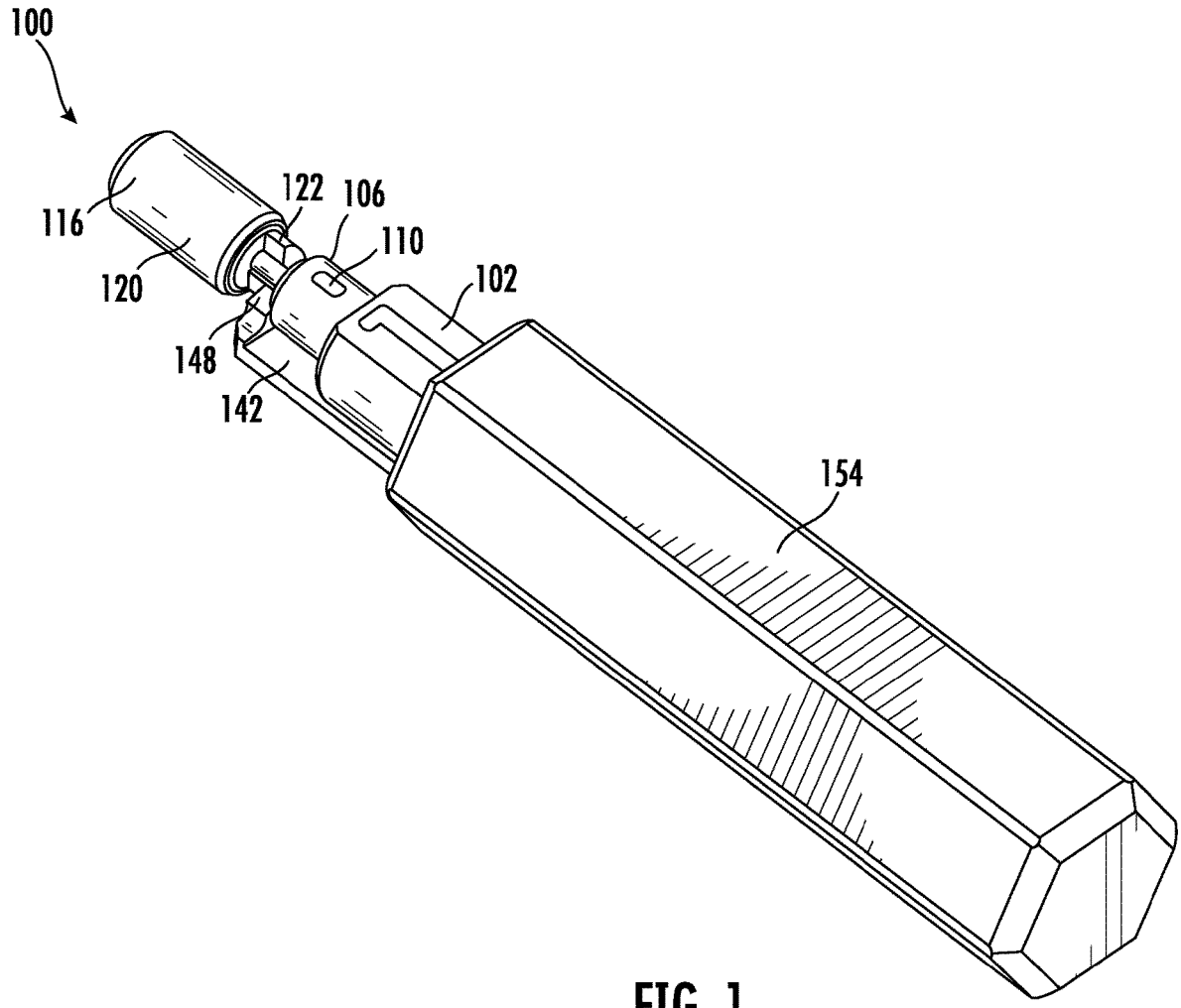
FIG. 1 illustrates a perspective view of an example high production tool for wire forming in accordance with one or more embodiments of the present disclosure.
Figure 2:
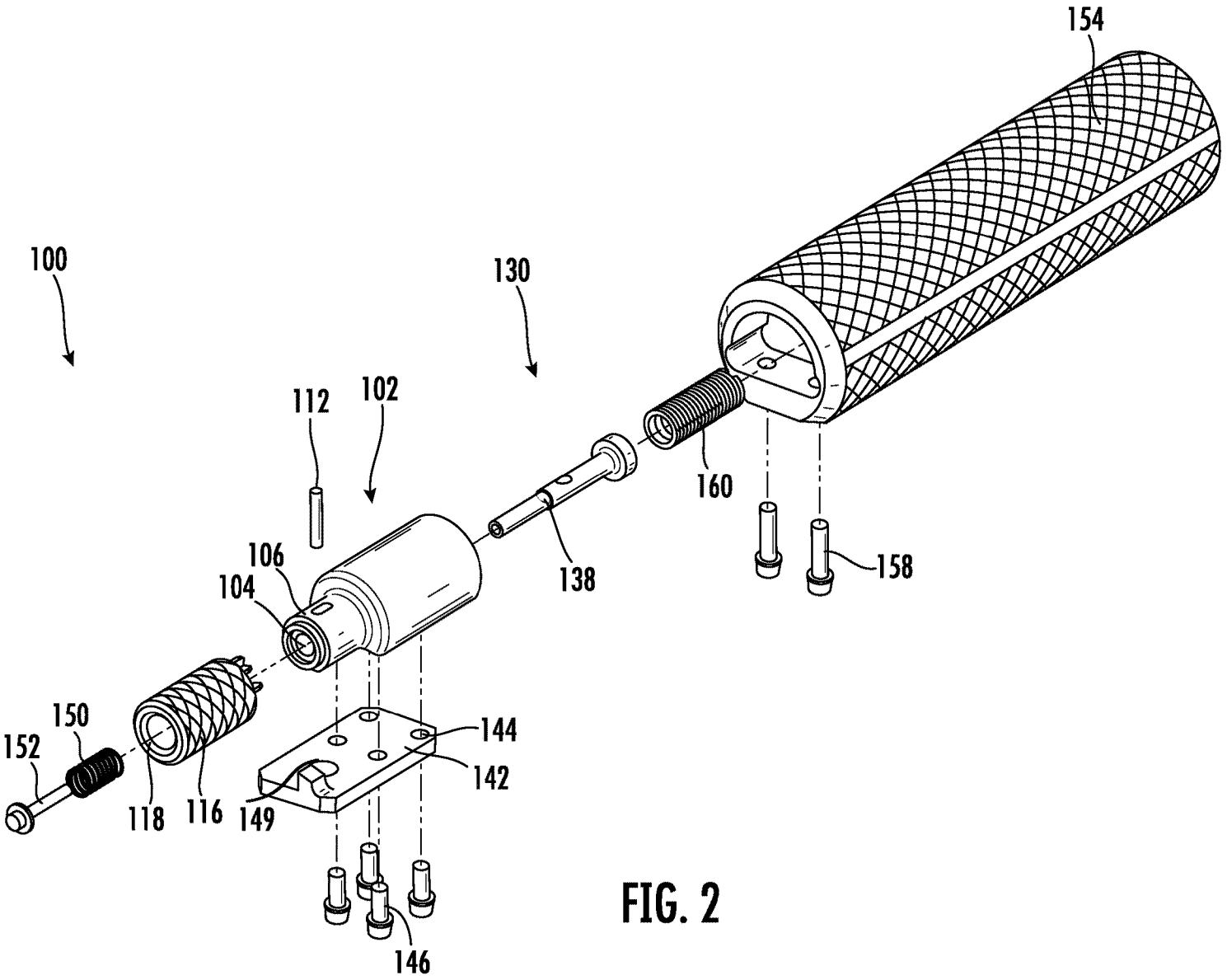
FIG. 2 illustrates an exploded schematic view of the example high production tool for wire forming in accordance with one or more embodiments of the present disclosure.
Figure 3:
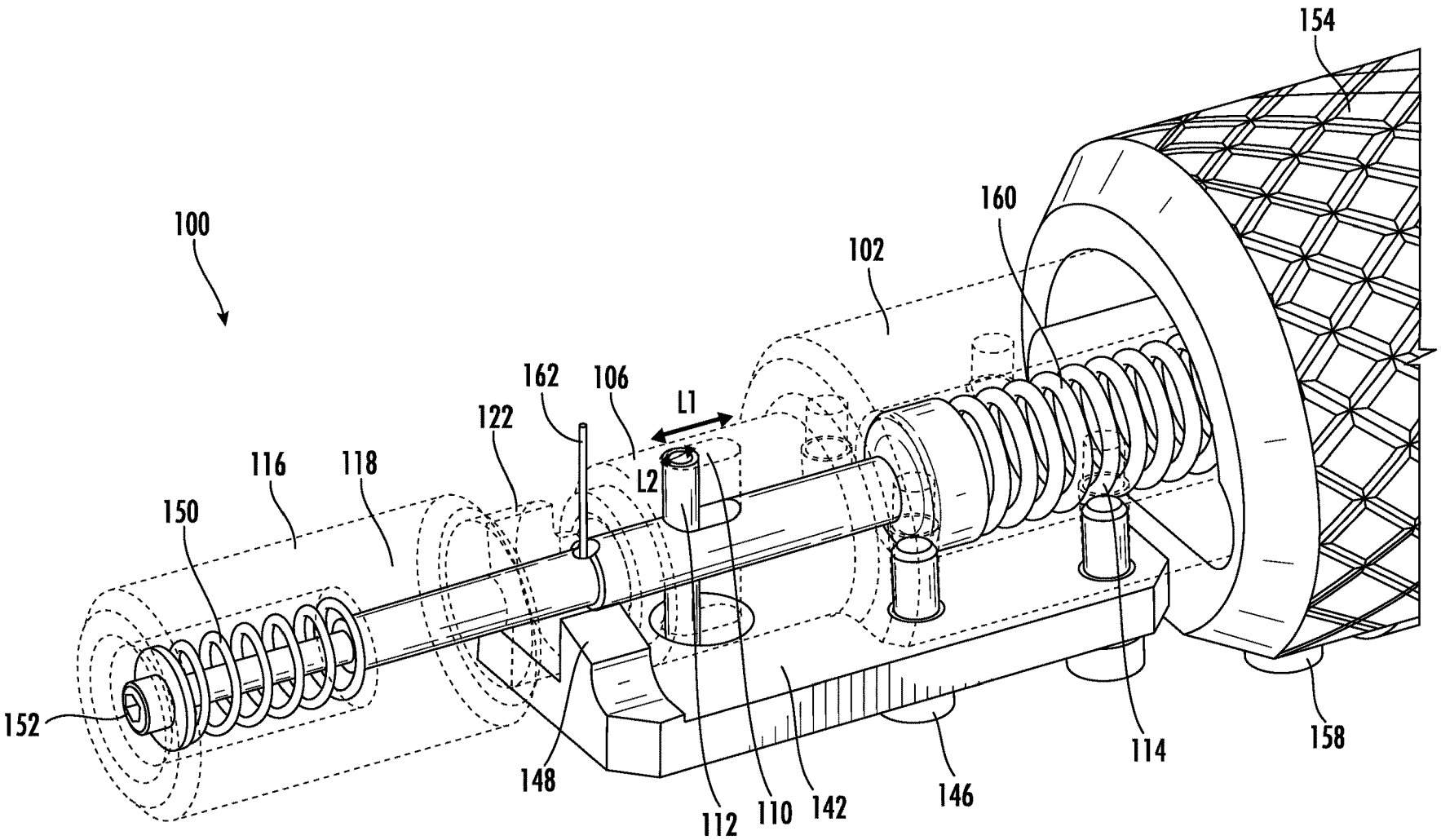
FIG. 3 illustrates a partial perspective view of the example high production tool for wire forming in accordance with one or more embodiments of the present disclosure.

Example embodiments will be described more fully hereinafter with reference to the accompanying drawings, in which some, but not all embodiments of disclosure are shown. Indeed, embodiments of the disclosure may be embodied in many different forms and should not be construed as limited to the embodiments set forth herein; rather, these embodiments are provided so that this disclosure will satisfy applicable legal requirements. Like numbers refer to like elements throughout.

Overview

Example embodiments disclosed herein address technical problems associated with producing formed wires. As would be understood by one skilled in the field to which this disclosure pertains, there are numerous example scenarios in which a user may need to produce formed wires.

In many applications, it is often necessary to produce a formed wire (e.g., a wire having a particular shape to obtain particular electrical characteristics and/or fit in a particular physical space). For example, in some channelizers, it is necessary to produce a formed wire having a u-shaped portion and an elbow-shaped portion to obtain electrical connection between an electrical trace and a resonator coil. In such applications, it is necessary that the formed wire is formed precisely to specification to ensure the correct electrical connection and that the wire properly fits in the physical space.

Example solutions for producing a formed wire include, for example, a technician using calipers and a microscope to create the formed wire. However, in some examples, such a solution is time consuming, inconsistent, and imprecise. For example, it may take a technician up to 15 minutes to create a single formed wire, and there may be subtle differences in each formed wire produced by the technician (e.g., due to human error). Accordingly, a technician using calipers and a microscope to create the formed wire results in higher costs (e.g., due to the length of time needed to create the wire) and reduced performance and/or accuracy in applications in which the formed wire is used. (e.g., subtle differences in formed wires due to human error).

Thus, to address these and/or other issues related to producing formed wires, a high production tool for forming wires and associated methods are disclosed herein. For example, an embodiment in this disclosure, described in greater detail below, includes a first anvil having a first chamber, a second anvil having a second chamber, and a mandrel. The mandrel may have a first portion disposed in the first chamber, a second portion disposed in the second chamber, and a third portion disposed in between the first portion and the second portion. The third portion may include a recess configured to receive a wire. The second anvil may be configured to be actuated from an open position to a closed position to transform the wire into a formed wire. Accordingly, the high production tool for forming wires enables the efficient production of a large quantity of identical formed wires.

High Production Tool for Wire Forming

With reference to FIGS. 1-14, embodiments herein provide for a high production tool for wire forming 100.

In some embodiments, the high production tool for wire forming 100 may include a first anvil 102. The first anvil 102 may have a first end 106 and a first chamber 104. In some embodiments, the first chamber 104 may extend through the entire first anvil 102. Alternatively, the first chamber 104 may extend through only a portion of the first anvil 102. The first chamber 104 may be substantially the same shape as the first anvil 102. Alternatively, the first chamber 104 may be a different shape than the first anvil 102 (e.g., the first chamber 104 may be substantially circular and the first anvil 102 may be substantially rectangular).

In some embodiments, the first anvil 102 may have a through hole 110. The through hole 110 may be substantially perpendicular to the first chamber 104. The through hole 110 may extend from the bottom of the first anvil 102, through the first chamber 104, and to the top of the first anvil 102. In some embodiments, the first anvil 102 may include an indent 108. The indent 108 may be at the first end 106 of the first anvil 102 and proximate the first chamber 104. In some embodiments, the first anvil 102 may include one or more sockets 114. The one or more sockets 114 may be each be configured to receive one or more fastening components (e.g., a screw).

In some embodiments, the first anvil 102 may be constructed out of any material suitable for wire forming and/or being constructed by a computer numerical control (CNC) machine, laser cutter, and/or 3D printer. For example, the first anvil 102 may be constructed out of one or more of brass, copper, aluminum, steel, titanium, and/or plastic. In some embodiments, the first anvil 102 may be any shape suitable for wire forming and/or being constructed by a CNC machine, laser cutter, and/or 3D printer. For example, the first anvil 102 may be one or more of substantially circular, substantially cubical, and/or substantially rectangular.

In some embodiments, the high production tool for wire forming 100 may include a second anvil 116. The second anvil 116 may include a second chamber 118. The second chamber 118 may extend through the entire second anvil 116. Alternatively, the second chamber 118 may extend through only a portion of the second anvil 116. The second anvil 116 may be substantially the same shape as the second anvil 116. Alternatively, the second chamber 118 may be a different shape than the second anvil 116 (e.g., the second chamber 118 may be substantially circular and the second anvil 116 may be substantially rectangular). The second anvil 116 may have a first end 120. The first end 120 of the second anvil 116 may be opposite the first end 106 of the first anvil 102.

In some embodiments, the second anvil 116 may include a knob 122. The knob 122 may be disposed at the first end 120 of the second anvil 116 and proximate the second chamber 118. In this regard, the knob 122 may extend outward towards the first anvil 102. In some embodiments, the second anvil 116 may include a knob protrusion 124. The knob protrusion 124 may be disposed on the knob 122. In this regard, the knob protrusion 124 may extend outward from the knob 122 towards the first anvil 102. In some embodiments, the knob protrusion 124 may be at least partially complimentary to the indent 108 in shape such that when the second anvil 116 is pushed towards the first anvil 102, the knob protrusion 124 may be configured to enter the indent 108. For example, the indent 108 may be substantially circular and the knob protrusion 124 may be a half circle with similar dimensions to the indent 108. In some embodiments, the second anvil 116 may include a wire guide 126. The wire guide 126 may be disposed on the knob protrusion 124. In this regard, the wire guide 126 may extend outward from the knob protrusion 124 towards the first anvil 102. In some embodiments, as the second anvil 116 is actuated, the wire guide 126 may be configured to prevent the wire 162 from moving in an undesired manner.

In some embodiments the second anvil 116 may be constructed out of any material suitable for wire forming and/or being constructed by a CNC machine, laser cutter, and/or 3D printer. For example, the second anvil 116 may be constructed out of one or more of brass, copper, aluminum, steel, titanium, and/or plastic. In some embodiments, the second anvil 116 may be any shape suitable for wire forming and/or being constructed by a CNC machine, laser cutter, and/or 3D printer. For example, the second anvil 116 may be one or more of substantially circular, substantially cubical, and/or substantially rectangular.

In some embodiments, the high production tool for wire forming 100 may include a mandrel 130. The mandrel 130 may include a first portion 132, a second portion 134, and a third portion 136. The first portion 132 may be disposed in the first chamber 104 of the first anvil 102. The second portion 134 may be disposed in the second chamber 118 of the second anvil 116. The third portion 136 may be in between the first portion 132 and the second portion 134. In some embodiments, the mandrel 130 may be held under tension. For example, the mandrel 130 may be held under tension via a first spring 150 proximate the second anvil 116, a bolt 152, and a second spring 160 proximate the first anvil 102.

In some embodiments, the mandrel 130 may include a recess 138. For example, the recess 138 may be in the third portion 136 of the mandrel 130. The recess 138 may be configured to receive a wire 162. In some embodiments, a diameter of the recess 138 may be based on the size of the wire 162. For example, if the wire 162 is American Wire Gauge (AWG), the diameter of the recess 138 may be approximately 15 mils. In some embodiments, the mandrel 130 may be include a mandrel through hole 140. The mandrel through hole 140 may be disposed in the first portion 132. The mandrel through hole 140 may align with the through hole 110 of the first anvil 102.

In some embodiments, the mandrel 130 may be constructed out of any material suitable for wire forming and/or being constructed by a CNC machine, laser cutter, and/or 3D printer. For example, the mandrel 130 may be constructed out of one or more of brass, copper, aluminum, steel, titanium, and/or plastic. In some embodiments, the first the mandrel 130 may be any shape suitable for wire forming and/or being constructed by a CNC machine, laser cutter, and/or 3D printer. For example, mandrel 130 may be one or more of substantially circular, substantially cubical, and/or substantially rectangular.

In some embodiments, the high production tool for wire forming 100 may include a plate 142. The plate 142 may be attached to the first anvil 102 via one or more fastening components. For example, the plate 142 may be attached to the first anvil 102 via one or more screws 146. In this regard, the plate 142 may include one or more plate sockets 144 that, when the plate 142 is attached to the first anvil 102, align with the one or more sockets 114. The one or more screws 146 may then be inserted into the one or more sockets 114 and the one or more plate sockets 144 to attach the plate 142 to the first anvil 102. In some embodiments, the plate 142 may include a plate through hole 149. The plate though hole 149 may align with the through hole 110 of the first anvil 102 and/or the mandrel though hole 140. In some embodiments, the plate 142 may include a stopper 148. The stopper 148 may be proximate the third portion 136 of the mandrel 130.

Figure 4:
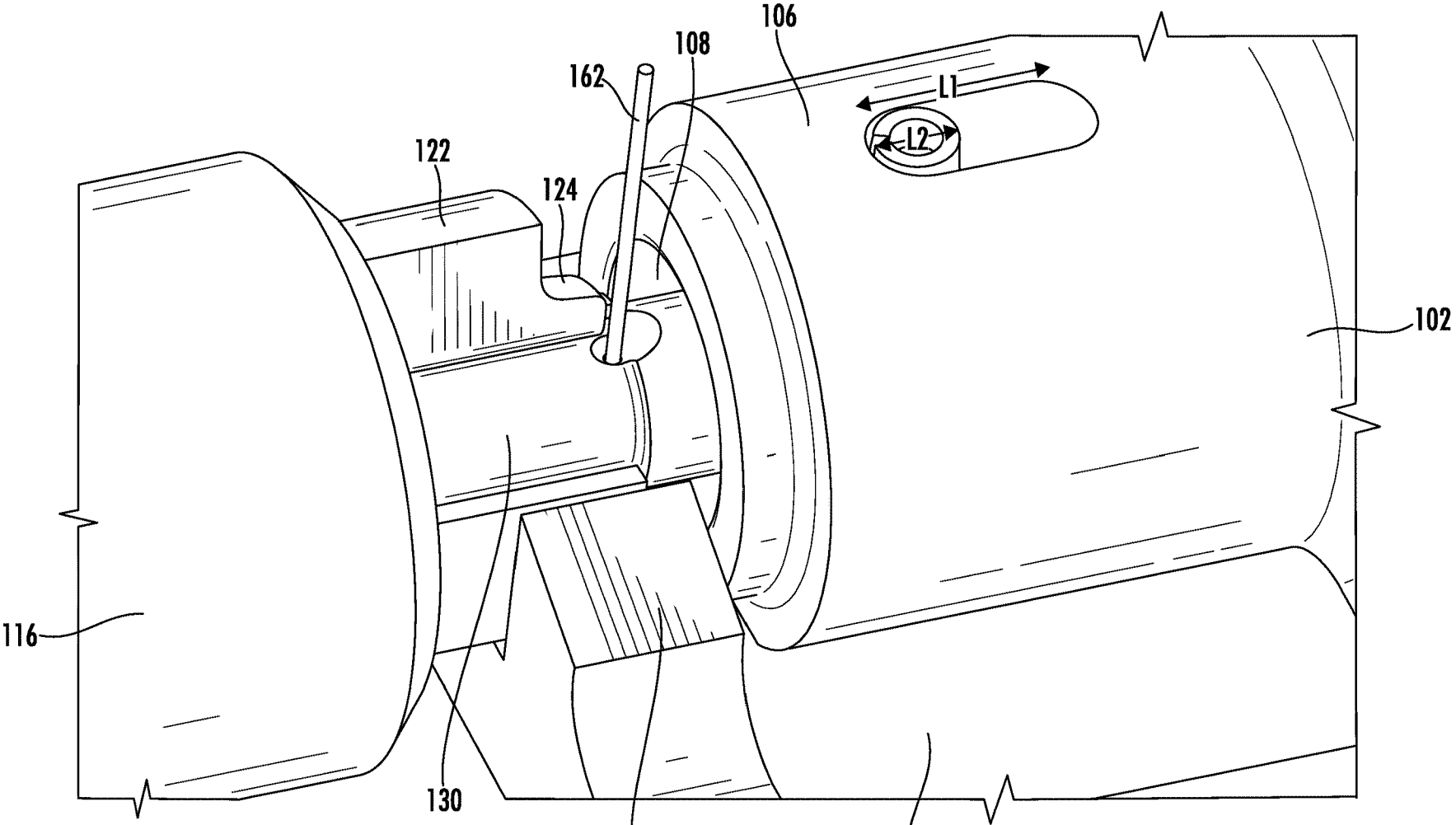
FIG. 4 illustrates a partial perspective view of the example high production tool for wire forming in accordance with one or more embodiments of the present disclosure.
Figure 5:
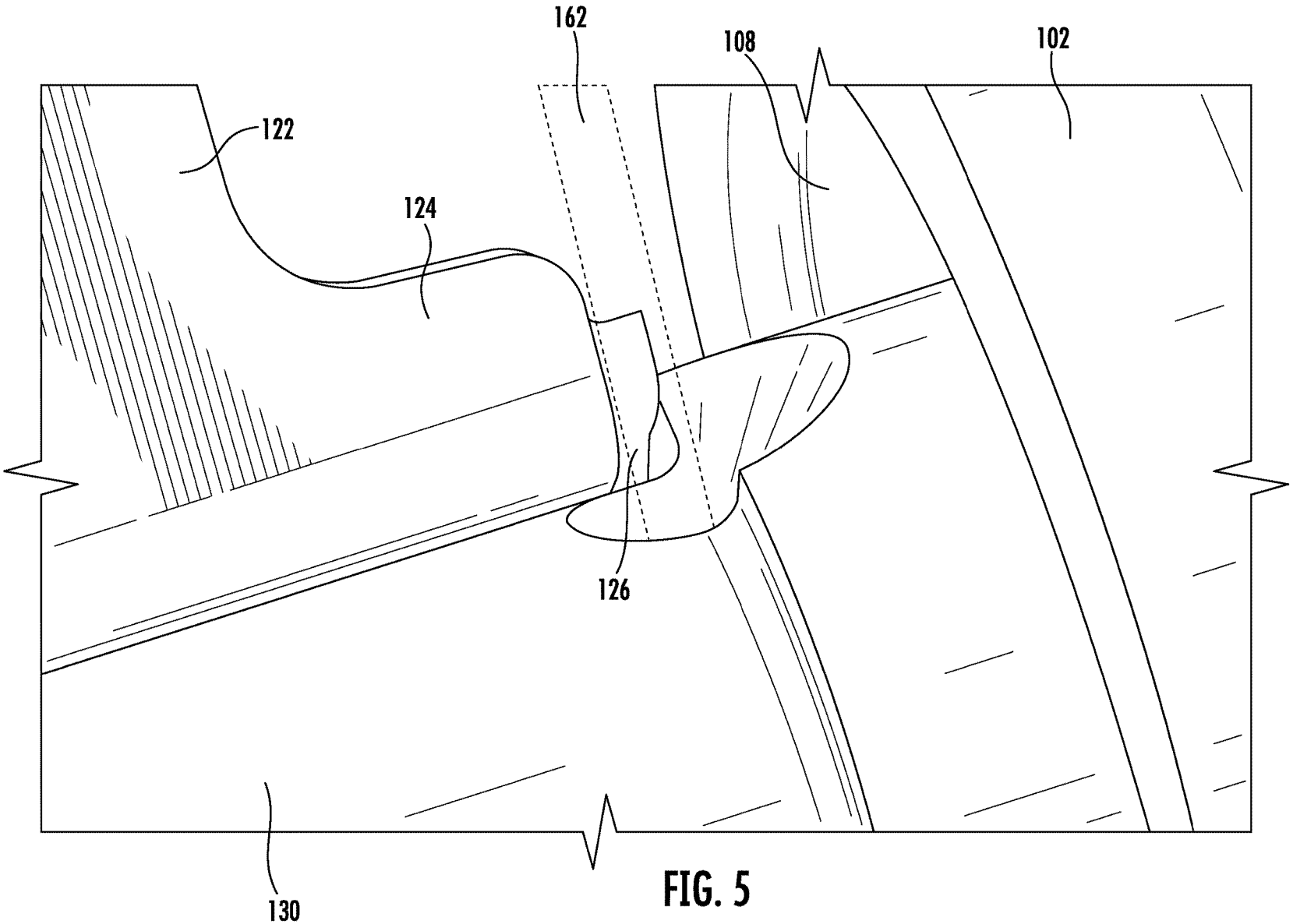
FIG. 5 illustrates a partial perspective view of the example high production tool for wire forming in accordance with one or more embodiments of the present disclosure.
Figure 6:
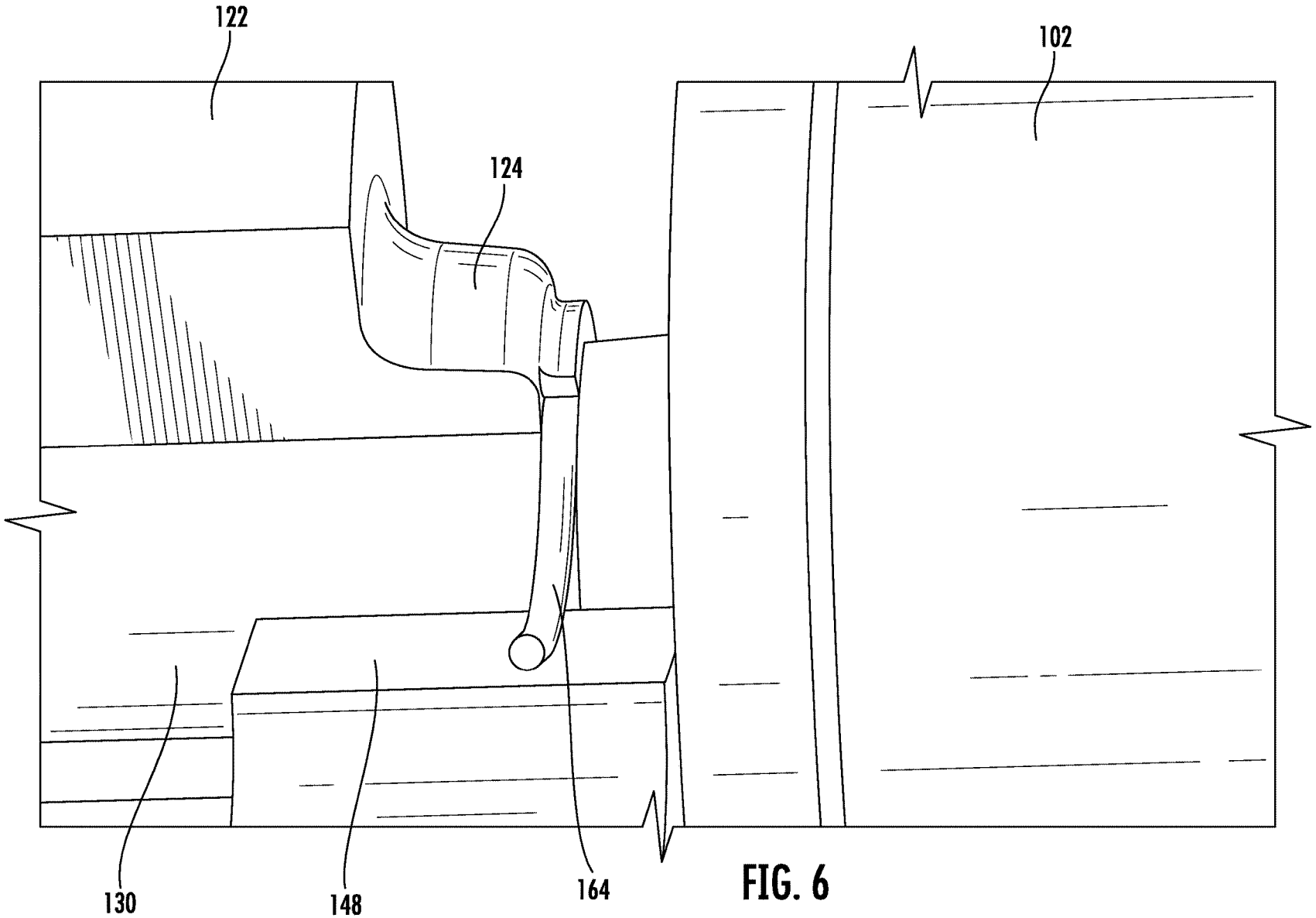
FIG. 6 illustrates a partial perspective view of the example high production tool for wire forming in accordance with one or more embodiments of the present disclosure.
Figure 7:
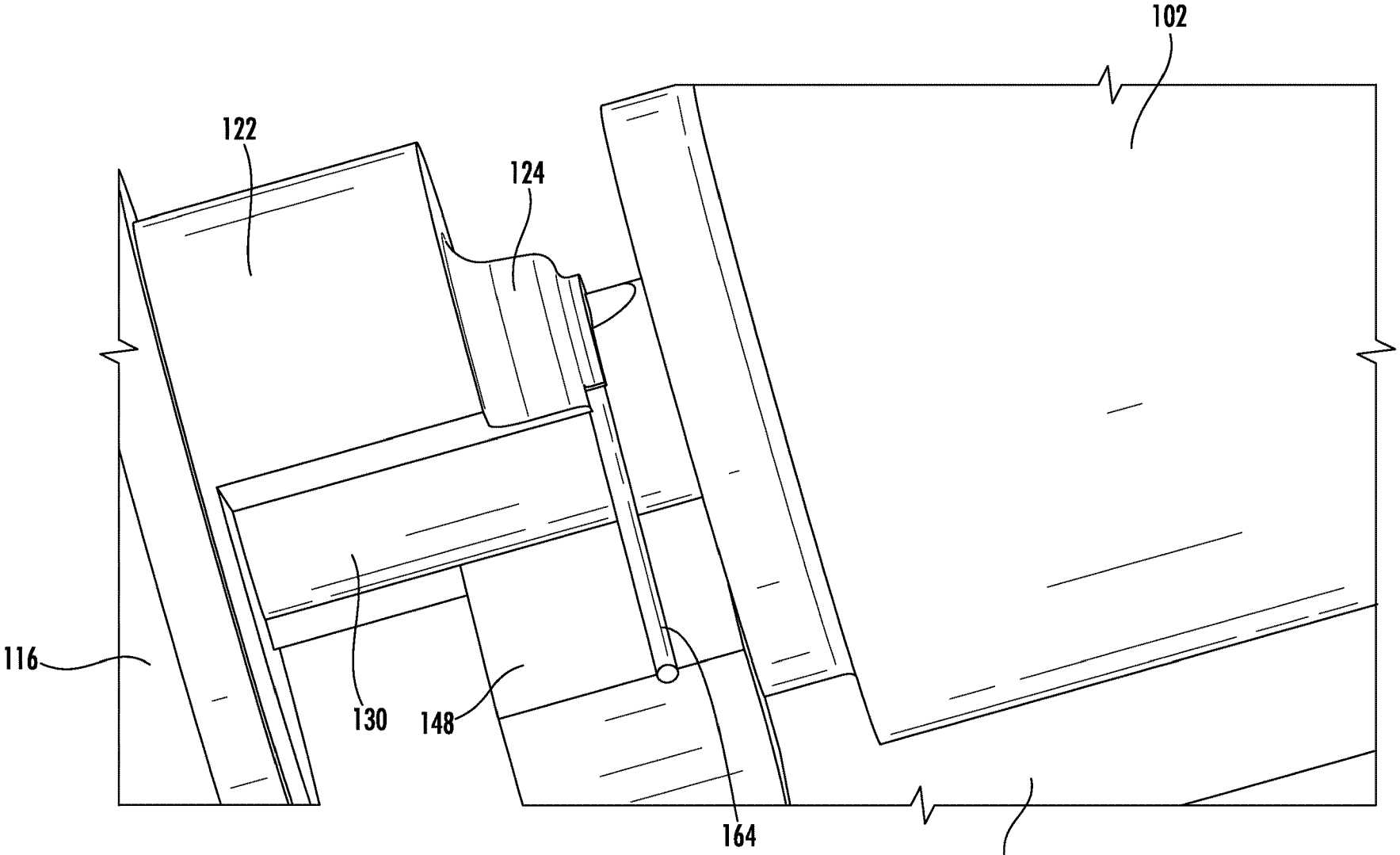
FIG. 7 illustrates a partial perspective view of the example high production tool for wire forming in accordance with one or more embodiments of the present disclosure.
Figure 8:
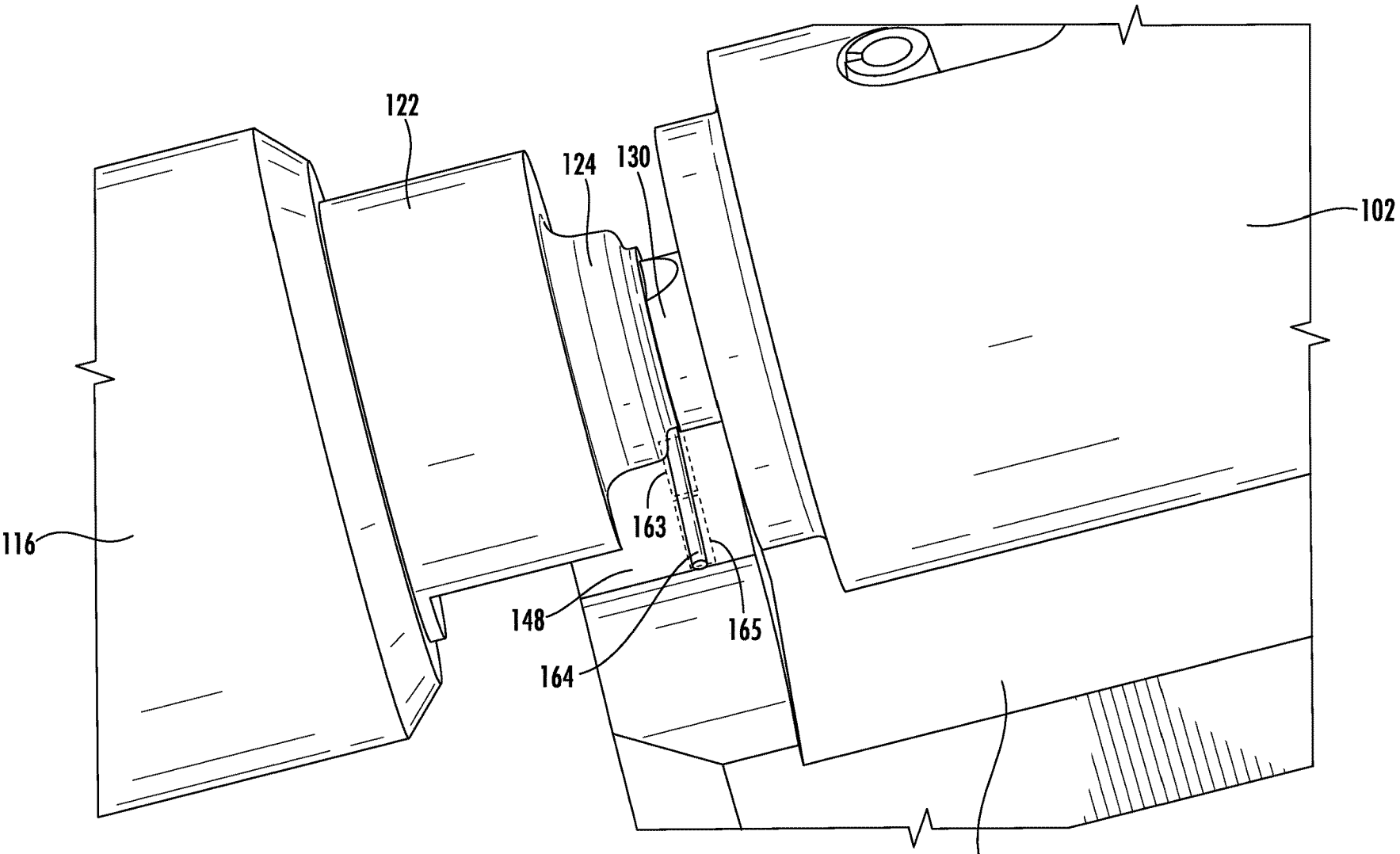
FIG. 8 illustrates a partial perspective view of the example high production tool for wire forming in accordance with one or more embodiments of the present disclosure.
Figure 9:
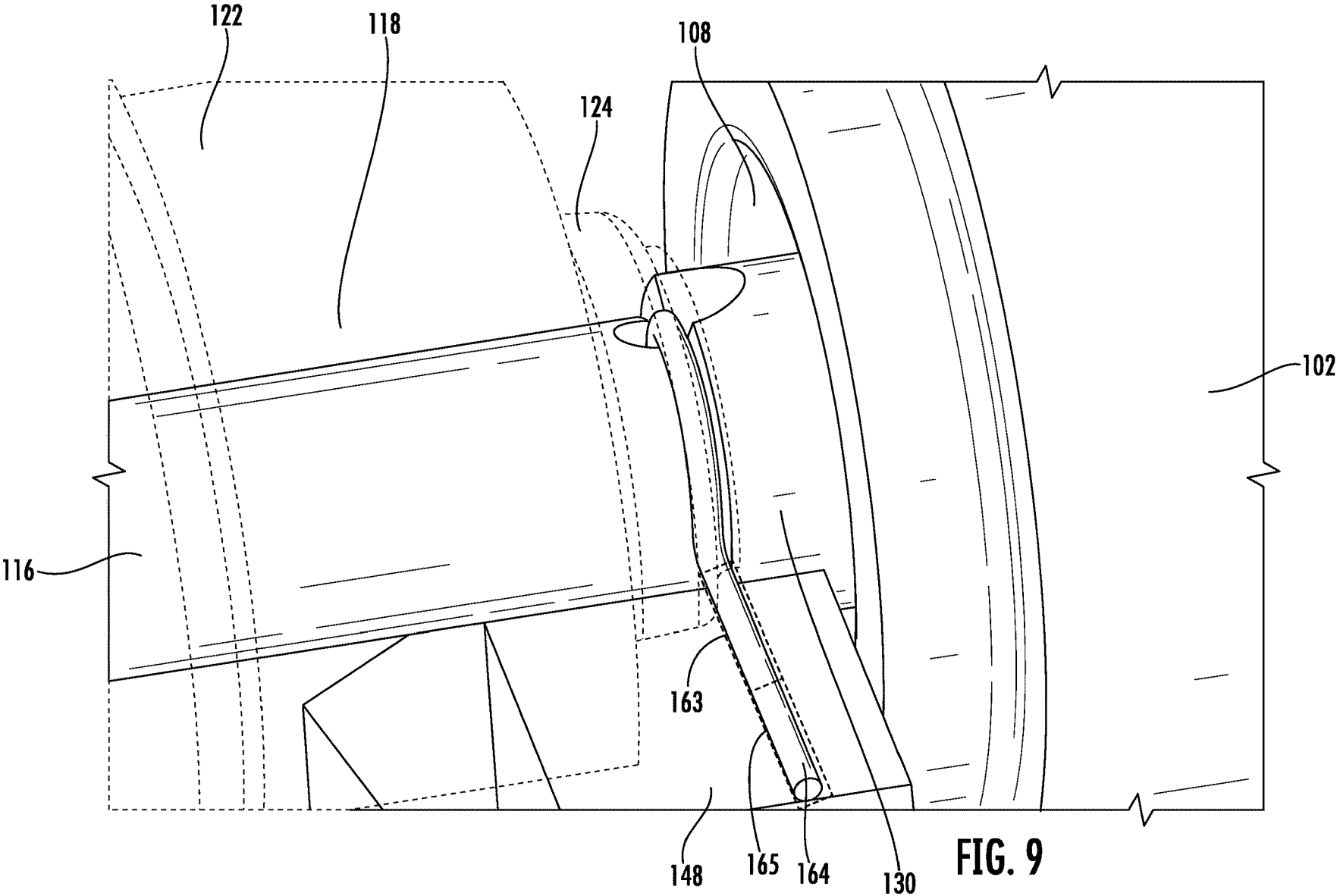
FIG. 9 illustrates a partial perspective view of the example high production tool for wire forming in accordance with one or more embodiments of the present disclosure.
Figure 10:
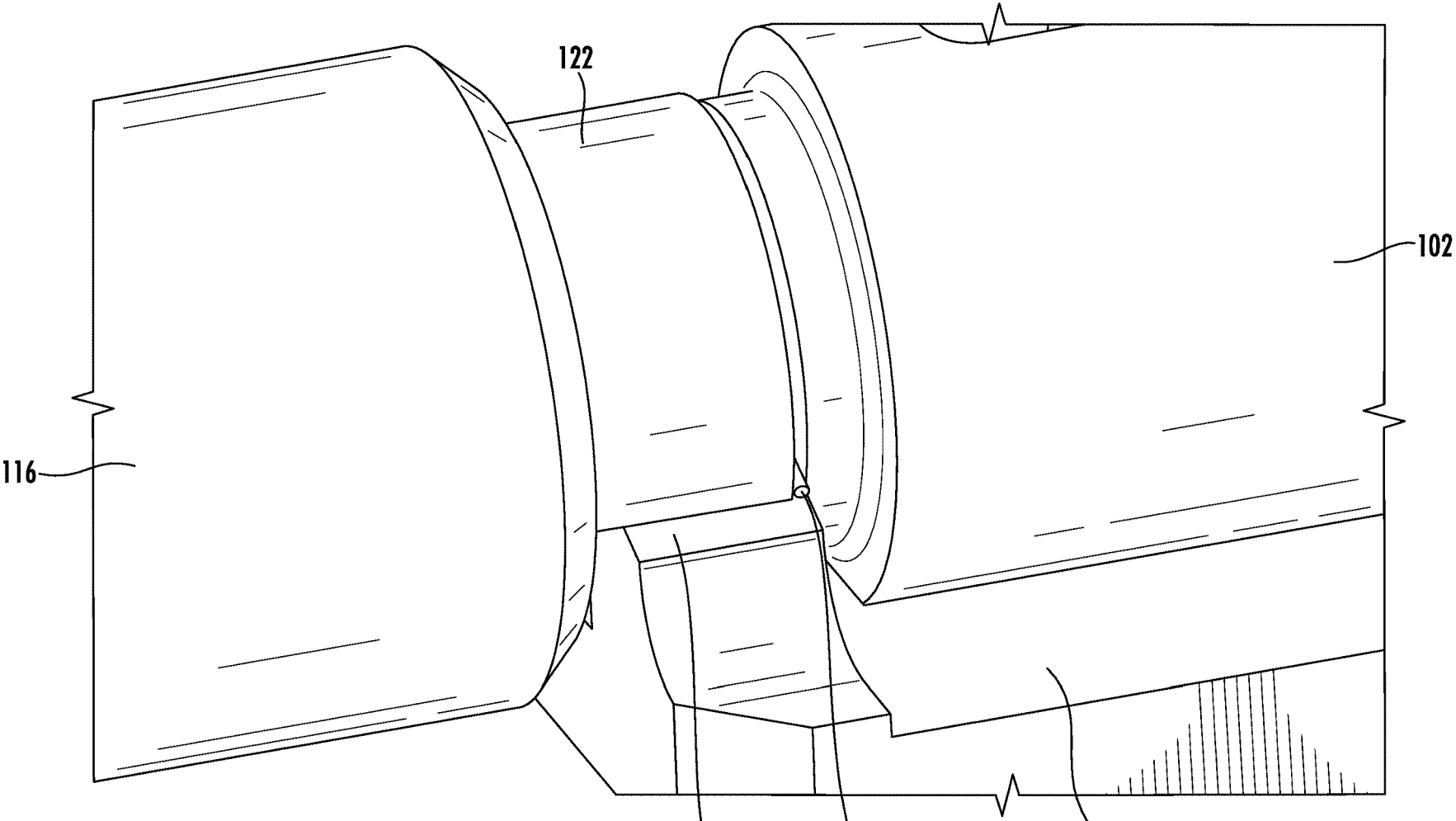
FIG. 10 illustrates a partial perspective view of the example high production tool for wire forming in accordance with one or more embodiments of the present disclosure.

In some embodiments, actuating the second anvil 116 may include rotating the second anvil 116 (e.g., around the mandrel 130) from a first position, such as depicted in FIG. 4, to a second position, such as depicted in FIG. 9. In some embodiments, the second anvil 116 may be configured to rotate a quarter turn (e.g., the second anvil 116 may be rotated by 90 degrees). In some embodiments, the knob 122 of the second anvil 116 may be in contact with the stopper 148 of the plate 142 when the second anvil 116 is in the second position. In this regard, the stopper 148 may be configured to at least partially cause the second anvil 116 to rotate by a quarter turn (e.g., the stopper 148 prevents the second anvil 116 from rotating more than a quarter turn). In some embodiments, rotating the second anvil 116 from the first position to the second position causes the wire 162 to transform into a curved wire 164, such as depicted in FIG. 9. In this regard, the curved wire 164 may include a u-shaped portion such as the u-shaped portion 168 in the formed wire 166.

Figure 11:
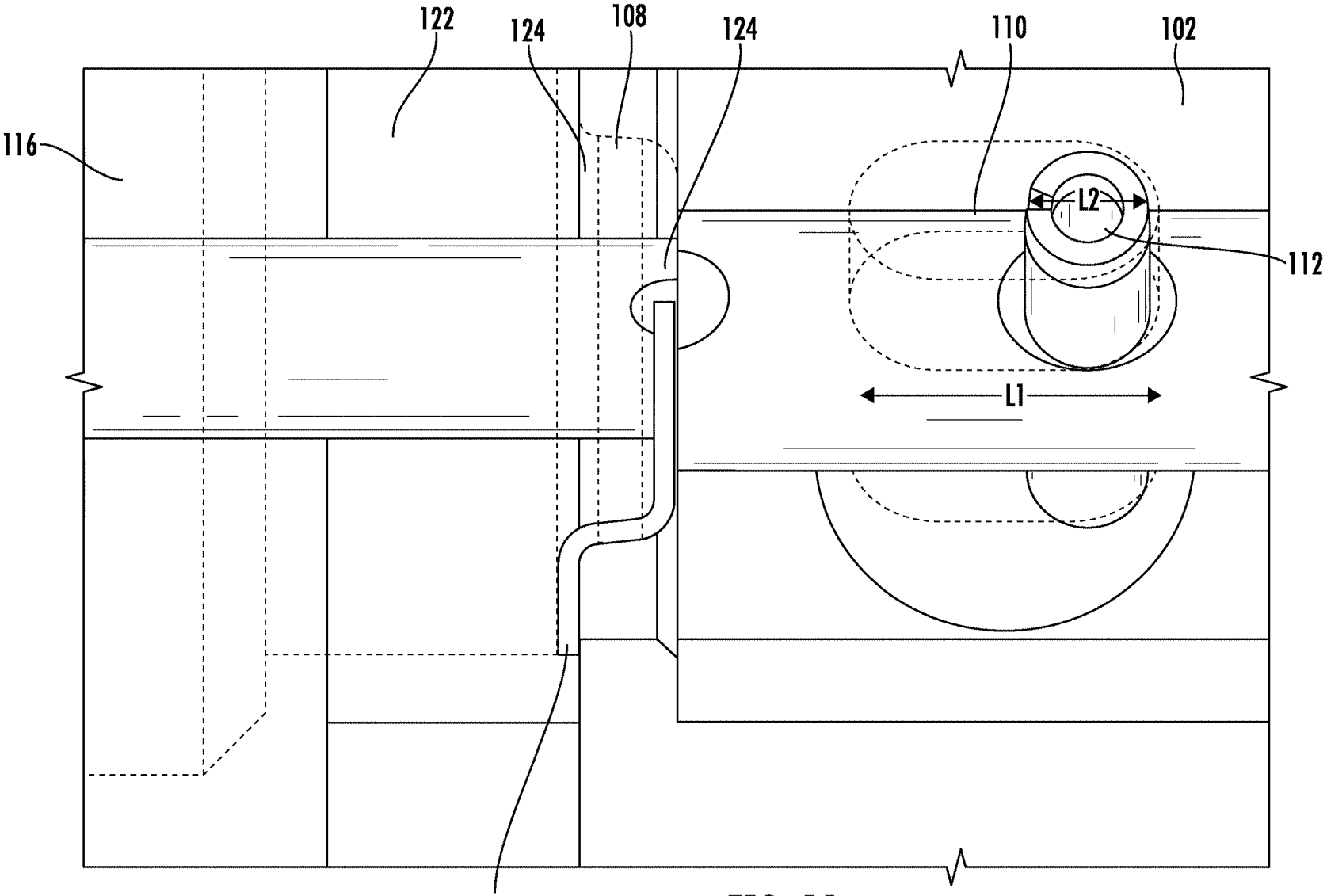
FIG. 11 illustrates a partial cross-sectional view of the example high production tool for wire forming in accordance with one or more embodiments of the present disclosure.
Figure 12:
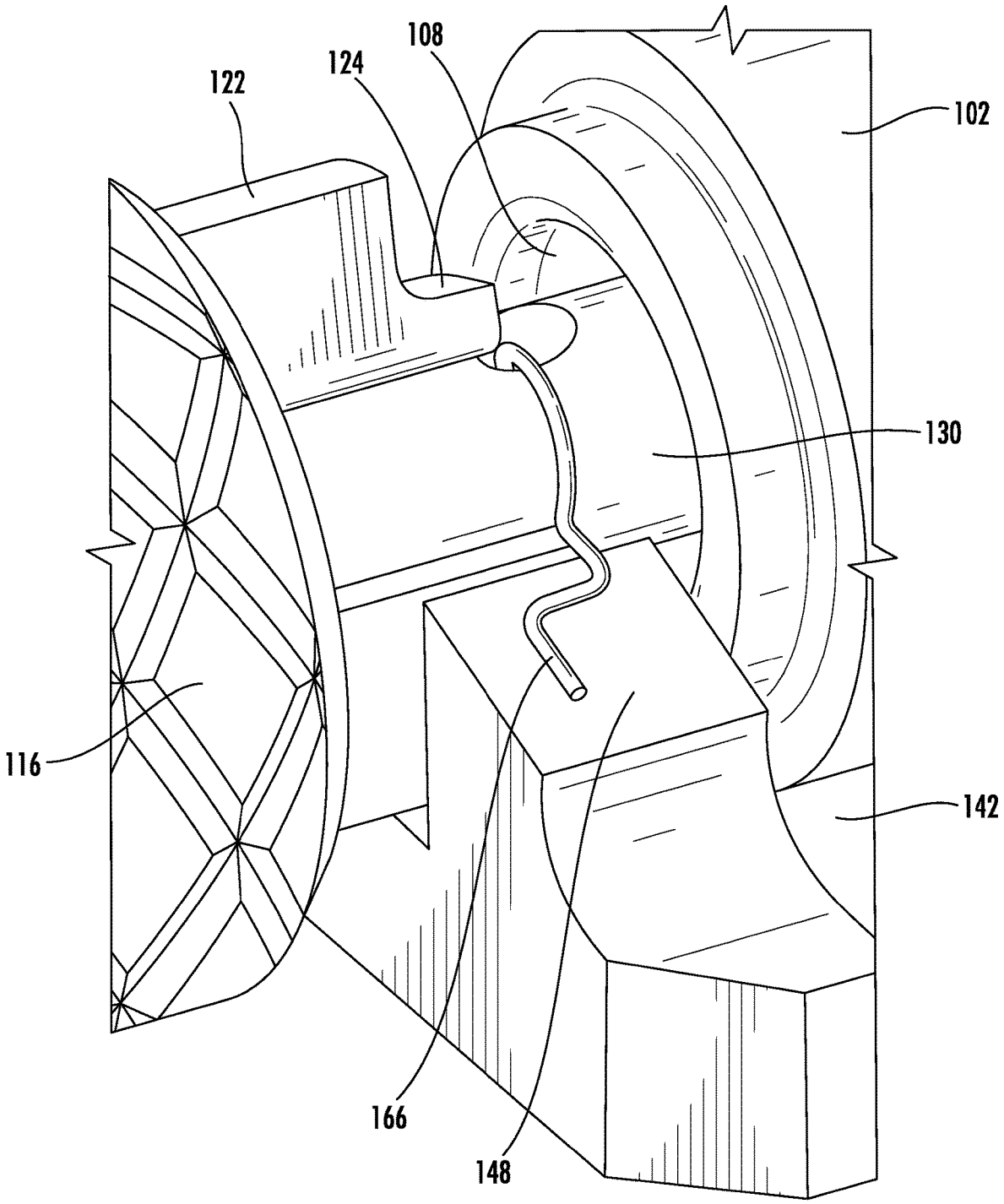
FIG. 12 illustrates a partial perspective view of the example high production tool for wire forming in accordance with one or more embodiments of the present disclosure.
Figure 13:
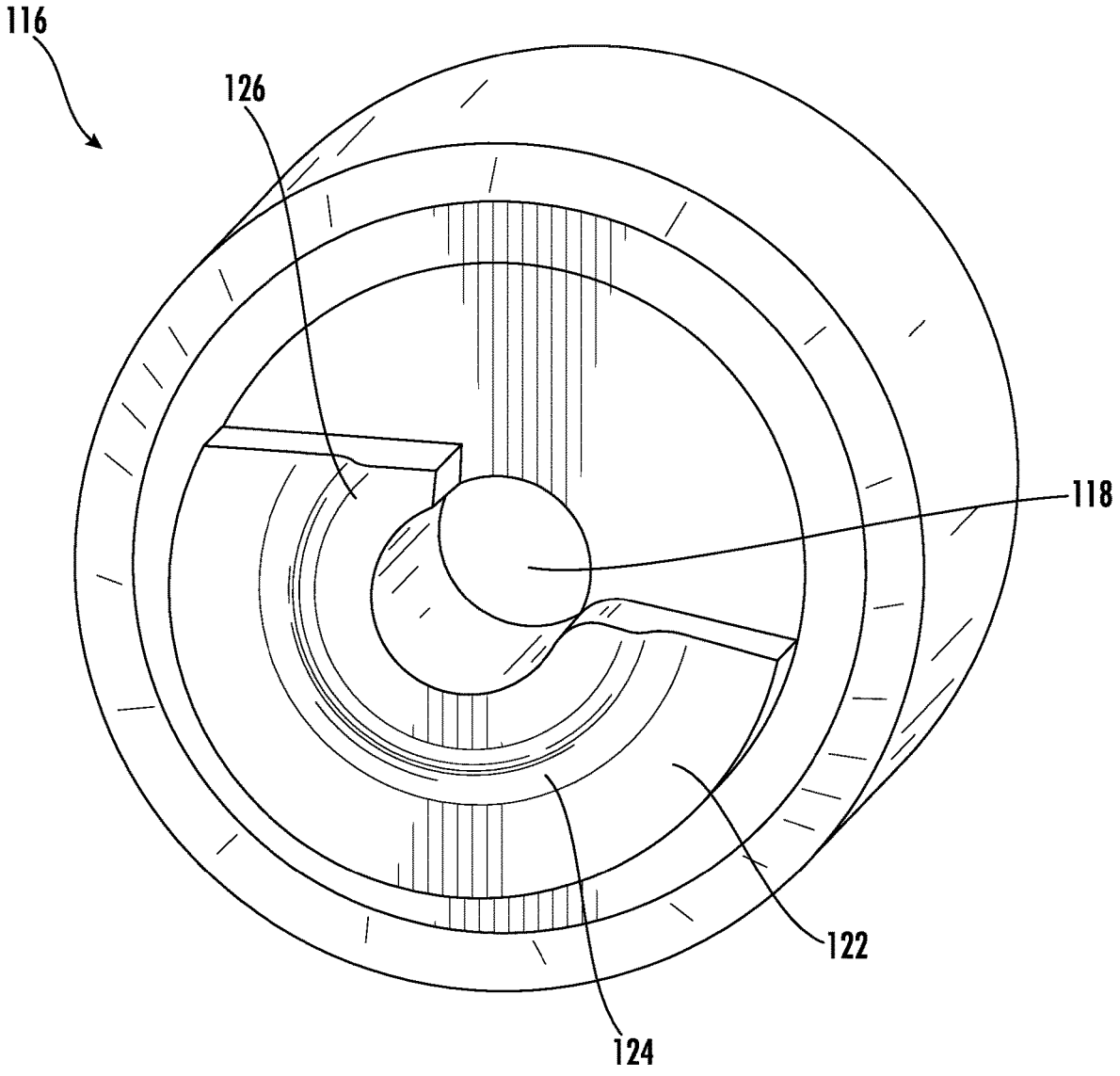
FIG. 13 illustrates a perspective view of a second anvil of the example high production tool for wire forming in accordance with one or more embodiments of the present disclosure.
Figure 14:
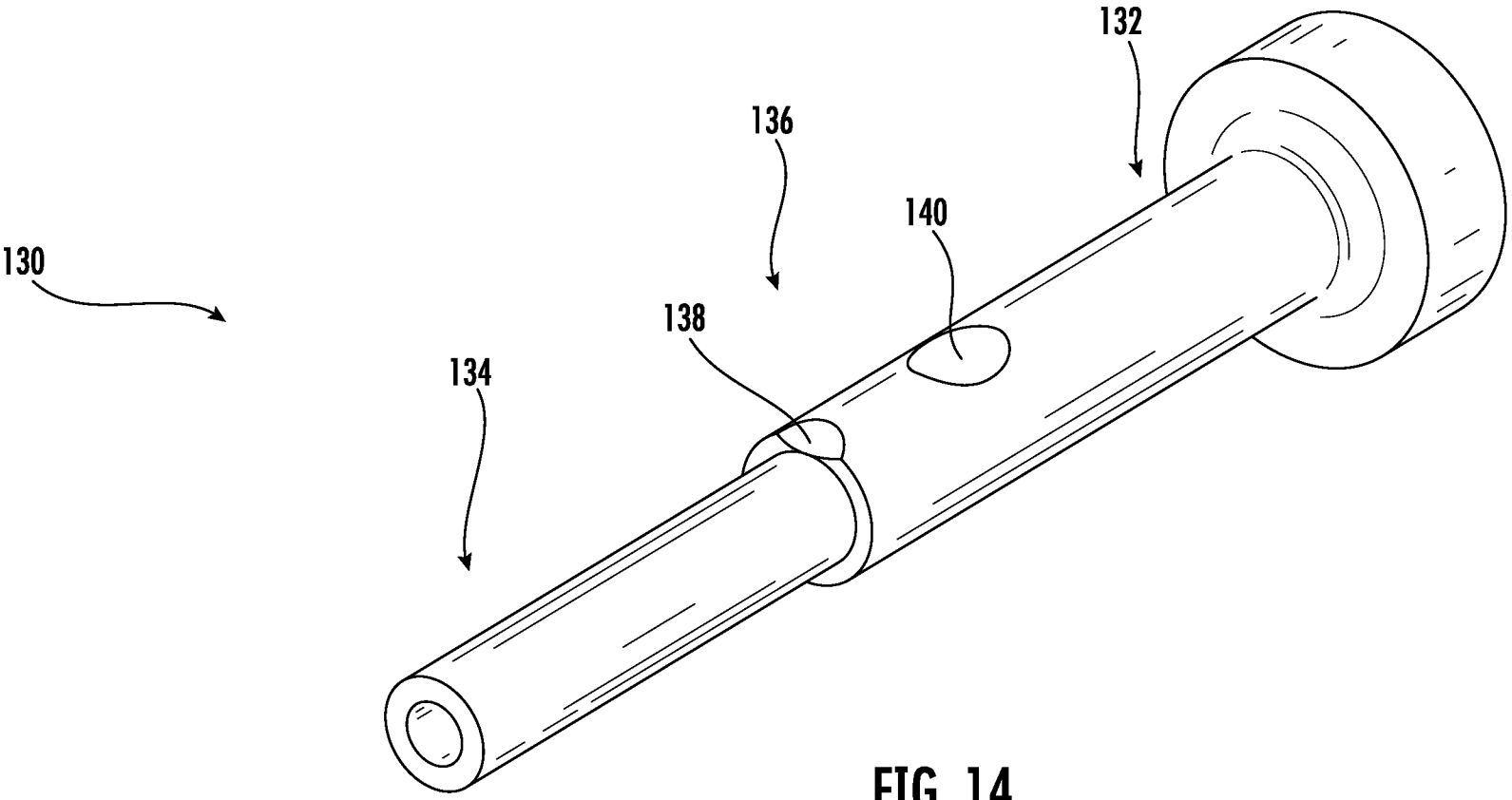
FIG. 14 illustrates a perspective view of a mandrel of the example high production tool for wire forming in accordance with one or more embodiments of the present disclosure.

In some embodiments, actuating the second anvil 116 may including pushing the second anvil 116 and the mandrel 130 towards the first anvil 102 (e.g., after the second anvil 116 has been rotated). In this regard, as the second anvil 116 and the mandrel 130 are pushed towards the first anvil 102, the knob protrusion 124 may enter the indent 108 of the first anvil 102. As the knob protrusion 124 enters the indent 108, a first portion 163 of the curved wire 164 is pushed by the knob protrusion 124 into the indent 108 while a second portion 165 of the curved wire 164 remains outside the indent 108 causing a bend to form in the curved wire 164. The second anvil 116 and the mandrel 130 may be pushed towards the first anvil 102 until the knob 122 contacts the first anvil 102 (e.g., the knob 122 contacts the first end 106) to create the formed wire 166, such as depicted in FIG. 11 (e.g., when the knob 122 contacts the first end 106 the curved wire 164 has been bent to form the elbow-shaped portion 170 of the formed wire 166). In some embodiments, the second anvil 116 and the mandrel 130 may be configured to be retracted (e.g., retracted to the place the second anvil 116 and the mandrel 130 were before being pushed) so that the formed wire 166 may be removed from the high production tool for wire forming 100.

In some embodiments, the high production tool for wire forming 100 may include a bar 112. The bar 112 may be inserted through the plate through hole 149, the through hole 110 of the first anvil 102, and the mandrel through hole 140. That is, the bar 112 may extend through the plate 142, the first anvil 102, and the mandrel 130. In this regard, the bar 112 may prevent the first anvil 102, the mandrel 130, and the plate 142 from rotating relative to each other. Accordingly, the second anvil 116 may be rotated to create the curved wire 164 while causing the first anvil 102 the mandrel 130, and the plate 142 to rotate (e.g., because the second anvil 116 is rotating around the mandrel 130). The plate through hole 149, the through hole 110 of the first anvil 102, and/or the mandrel through hole 140 may have a length L1. The bar 112 may have a length L2. In some embodiments, the length L2 may be less than the length L1. In this regard, the bar 112 may only occupy a portion of the plate through hole 149, the through hole 110 of the first anvil 102, and the mandrel through hole 140. As such, the bar 112 may be configured to move along the length L1 when the second anvil 116 and the mandrel 130 are pushed towards the first anvil 102.

In some embodiments, the high production tool for wire forming 100 may include a handle 154. In some embodiments, the handle 154 may be fixed to the first anvil 102 by one or more fastening components. For example, the handle 154 may be fixed to the first anvil 102 via one or more handle screws 158. The handle 154 may be constructed out of any material suitable for using the high production tool for wire forming 100 for transforming the wire 162 into the formed wire 166. For example, the handle 154 may be constructed out of plastic. In this regard, the handle 154 may be 3D printed.

Figure 16:
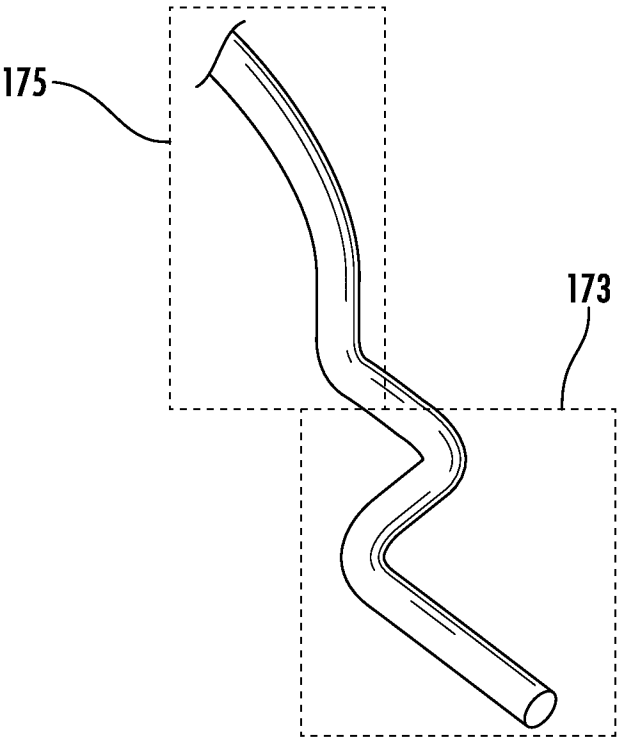
FIG. 16 illustrates a perspective view of a trimmed wire in accordance with one or more embodiments of the present disclosure.
Figure 15:
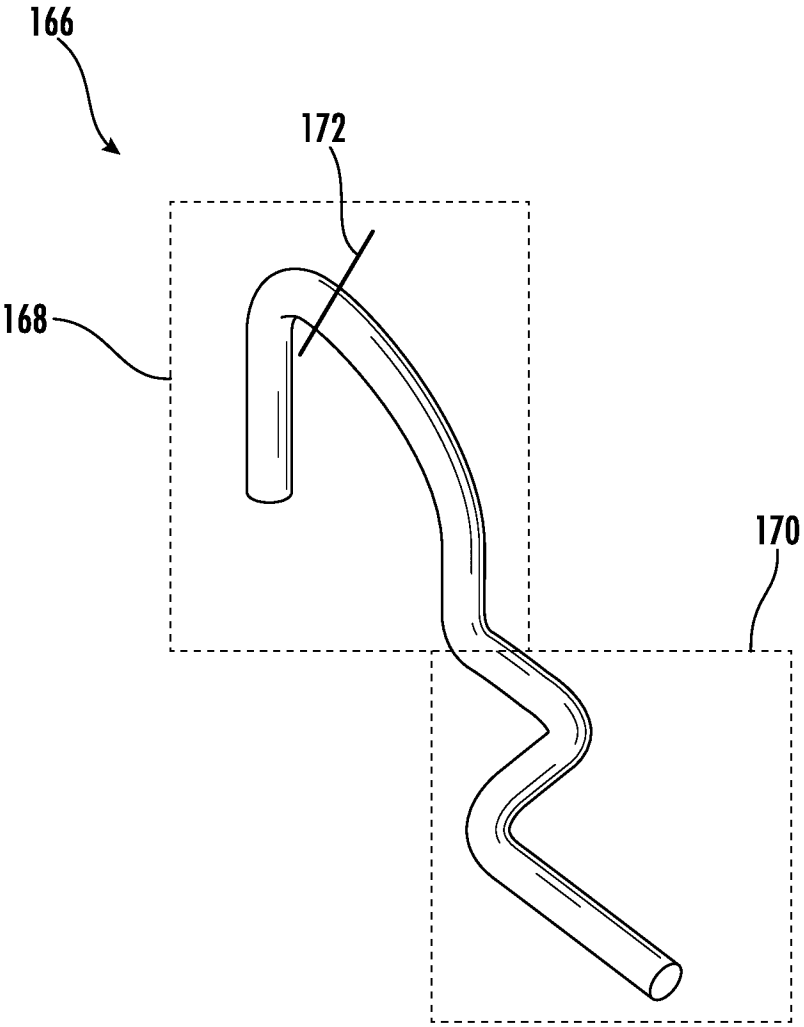
FIG. 15 illustrates a perspective view of a formed wire produced by the example high production tool for wire forming in accordance with one or more embodiments of the present disclosure.

In some embodiments, the wire 162 may be associated with a gauge. For example, the wire 162 may have a gauge in the range of 20 AWG to 40 AWG. In some embodiments, the wire 162 may comprise a conductive material. In this regard, the wire 162 may comprise one or more of copper, iron, gold, aluminum, and/or silver. For example, the wire 162 may be silver plated annealed copper. In some embodiments, the formed wire 166 may include a u-shaped portion 168 and an elbow-shaped portion 170. In some embodiments, the formed wire 166 may be trimmed along a trim line 172 to create a trimmed wire 174, such as depicted in FIG. 16. In this regard, the trimmed wire 174 may include an elbow-shaped portion 173 (e.g., the elbow-shaped portion 173 may be identical to the elbow-shaped portion 170 of the formed wire 166) and a hook-shaped portion 175 (e.g., the hook-shaped portion 175 may include the u-shaped portion 168 of the formed wire 166 that was not trimmed).

Figure 17:
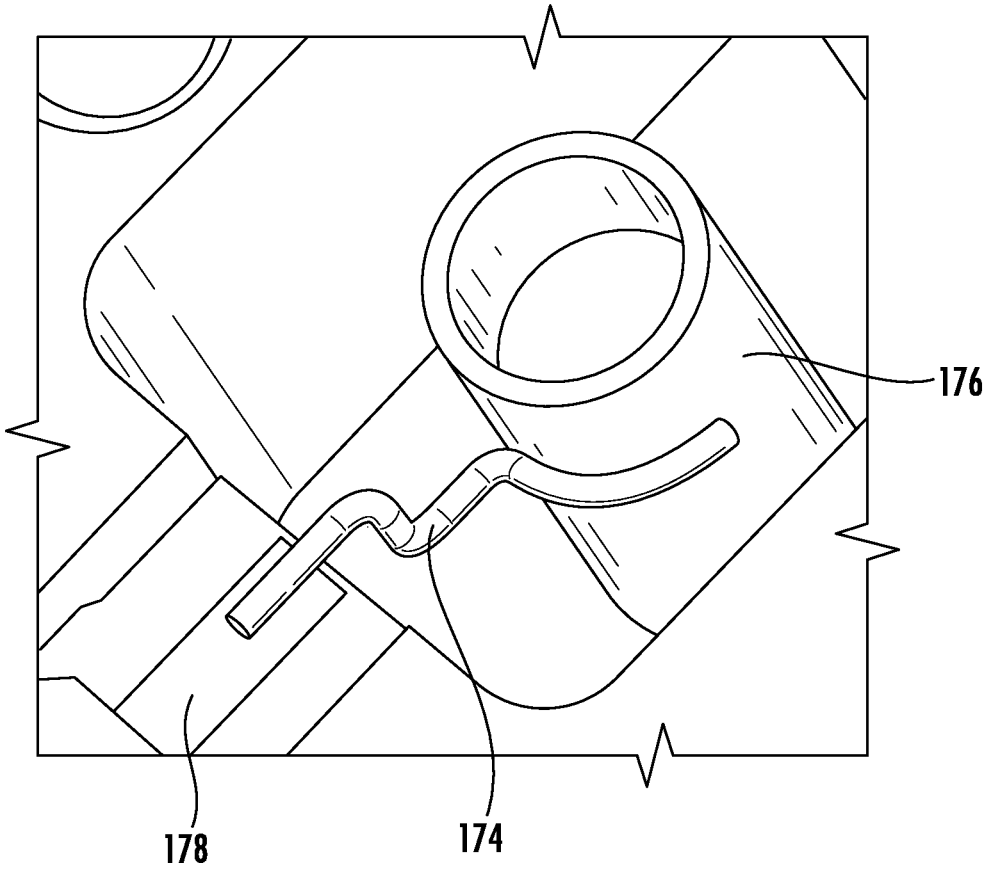
FIG. 17 illustrates a perspective view of a formed wire attached to a resonator coil in accordance with one or more embodiments of the present disclosure.
Figure 18:
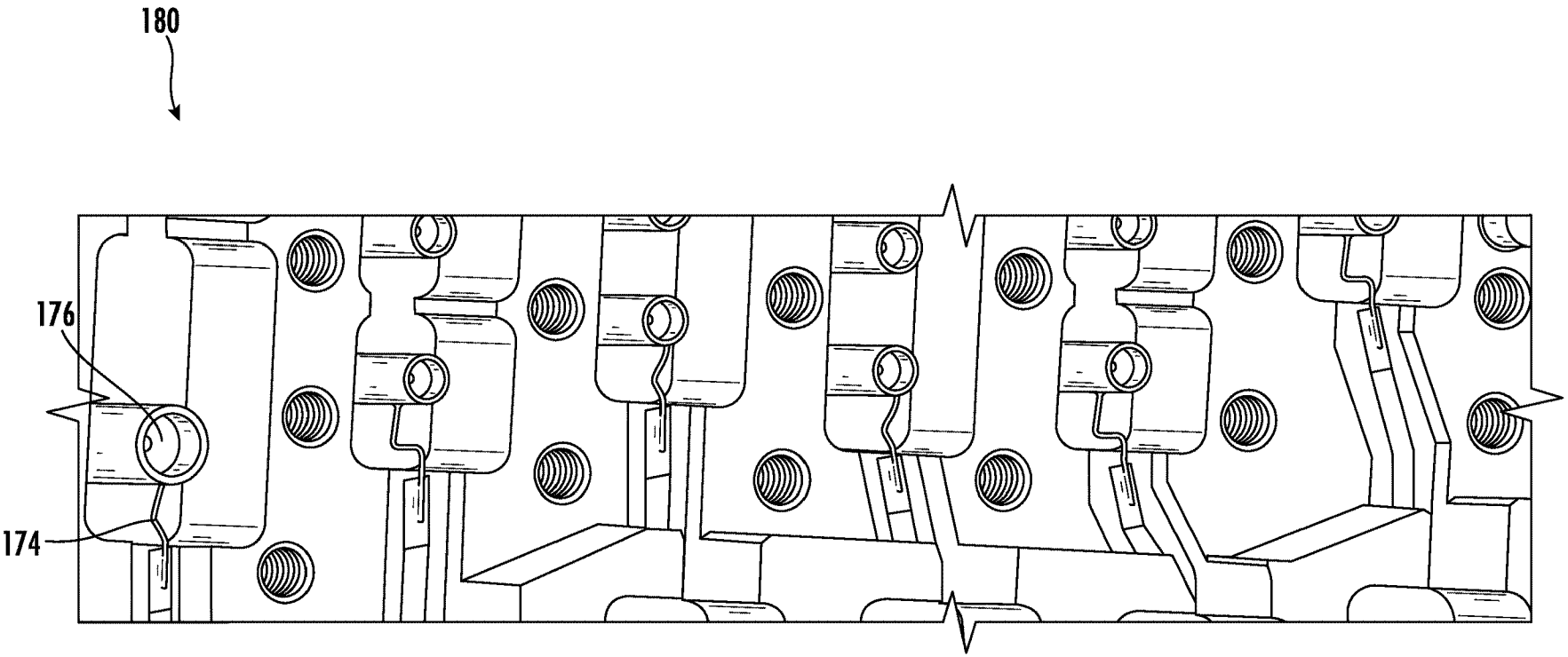
FIG. 18 illustrates a perspective view of a bank of resonators in accordance with one or more embodiments of the present disclosure.

In some embodiments, such as depicted in FIG. 17, the trimmed wire 174 may be used to create an electrical connection between an electrical trace 178 and a resonator coil 176. In this regard, the elbow-shaped portion 173 may be in contact with the electrical trace 178 and the hook-shaped portion 175 may be in contact with the resonator coil 176. In this regard, the elbow-shaped portion 173 may account for a difference in elevation between the electrical trace 178 and the resonator coil 176 (e.g., the electrical trace 178 may be at a higher elevation than the resonator coil 176). The hook-shaped portion 175 may account for the circular shape of the resonator coil 176. For example, to ensure the trimmed wire 174 provides a sufficient electrical connection between the electrical trace 178 and the resonator coil 176, it may be necessary that the entire hook-shaped portion 175 is in contact with the resonator coil 176. In some embodiments, such as depicted in FIG. 18, the high production tool for wire forming 100 may be used to create multiple trimmed wires for use in a bank of resonators 180.

Example Method for Producing a Formed Wire

Referring now to FIGS. 19-22, a method for producing a formed wire 1900 is illustrated. In this regard, FIGS. 19-23 represent operations that may be performed using the high production tool for wire forming 100.

Figure 19:
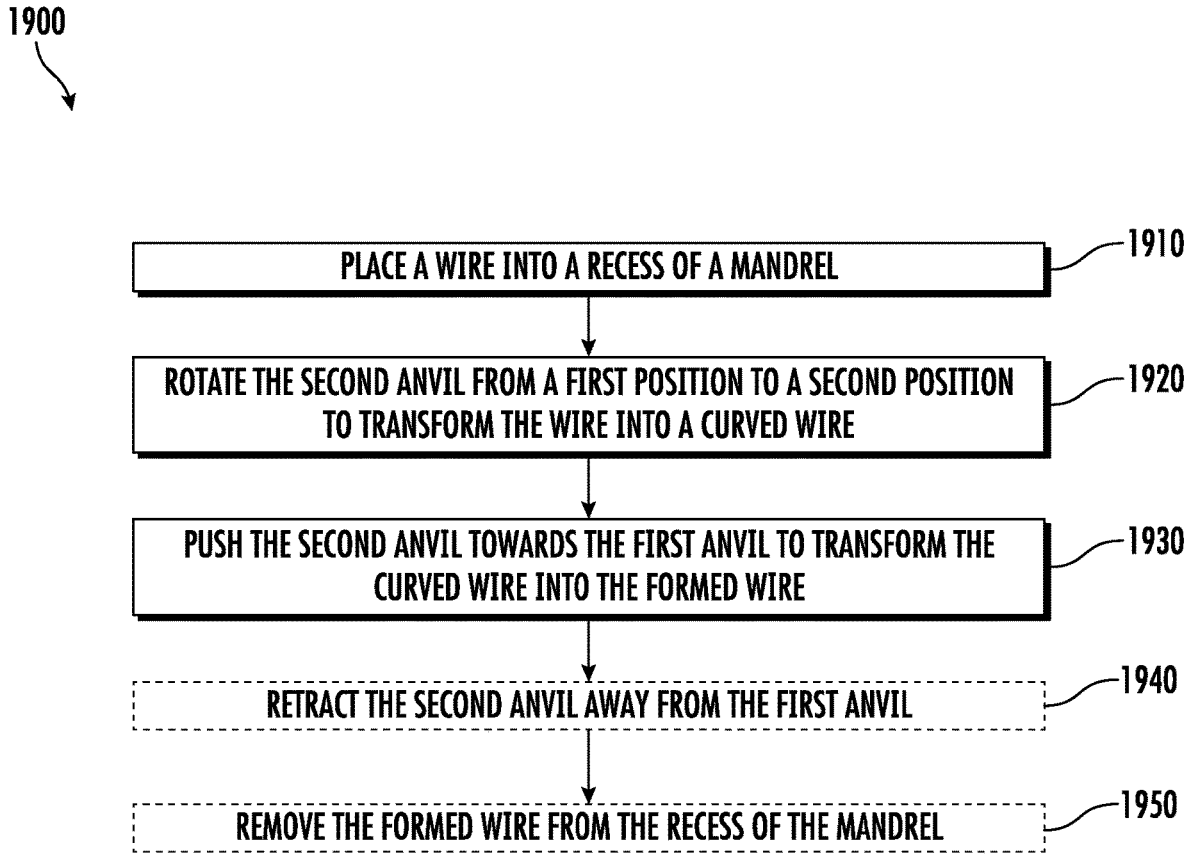
FIG. 19 illustrates a flowchart of an example method of creating a formed wire in accordance with one or more embodiments of the present disclosure.
Figure 20:
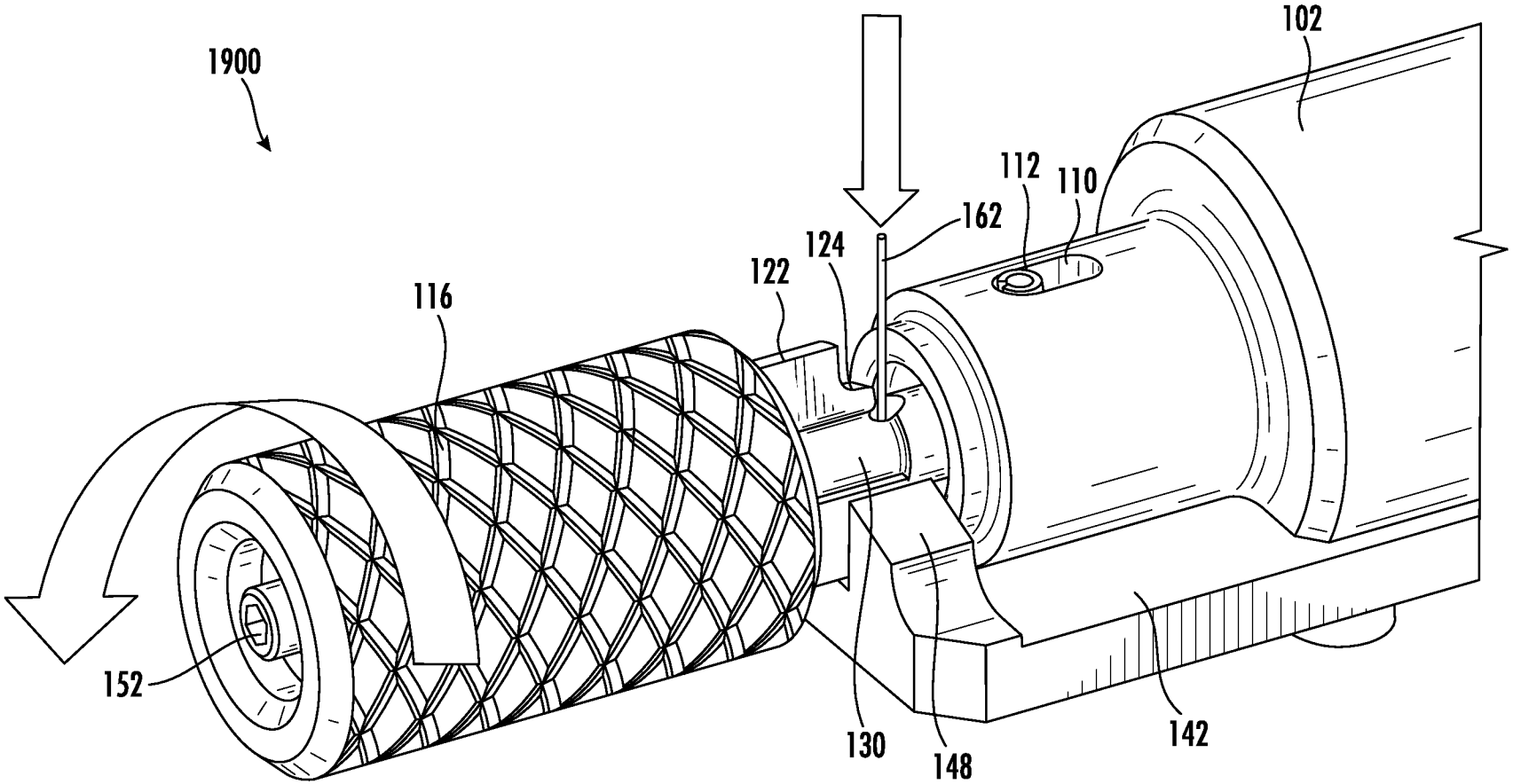
FIG. 20 illustrates an example high production tool for wire forming undergoing the method illustrated in FIG. 19 in accordance with one or more embodiments of the present disclosure.

As shown in block 1910 of FIG. 19, the method of producing a formed wire may include placing a wire into a recess of a mandrel. As described above, the mandrel may have a first portion disposed in a first chamber of a first anvil, a second portion disposed in a second chamber of a second anvil, and a third portion in between the first portion and the second portion, such as illustrated in FIG. 20. As described above, a plate may be fixed to the first anvil and the plate may include a stopper proximate the third portion of the mandrel. As described above, the second anvil may include a knob disposed at a first end of the second anvil and proximate the second chamber. In this regard, the knob may extend outward towards the first anvil. In some embodiments, the second anvil may include a knob protrusion. The knob protrusion may be disposed on the knob. In this regard, the knob protrusion may extend outward from the knob towards the first anvil.

Figure 21:
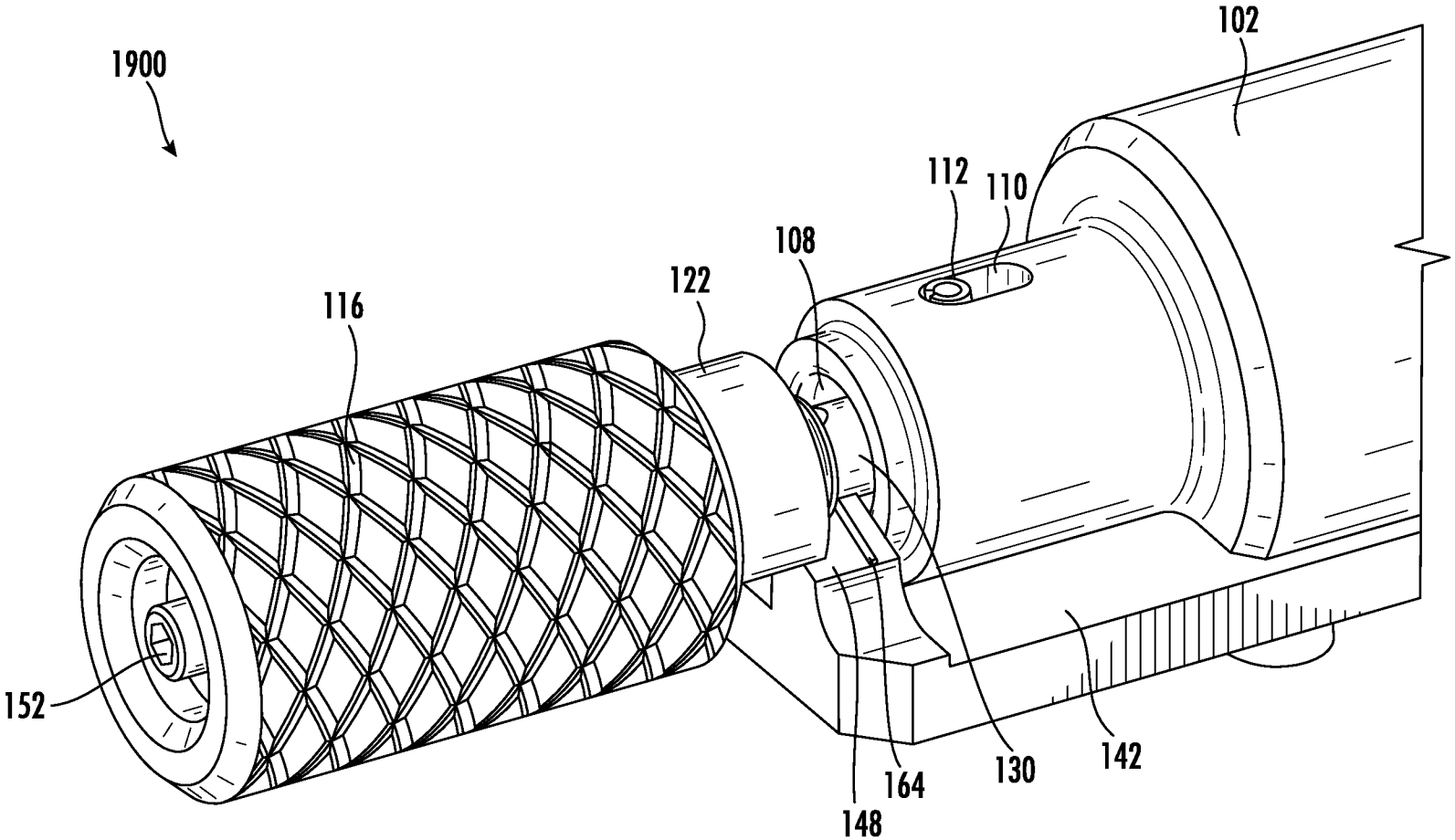
FIG. 21 illustrates an example high production tool for wire forming undergoing the method illustrated in FIG. 19 in accordance with one or more embodiments of the present disclosure.
Figure 22:
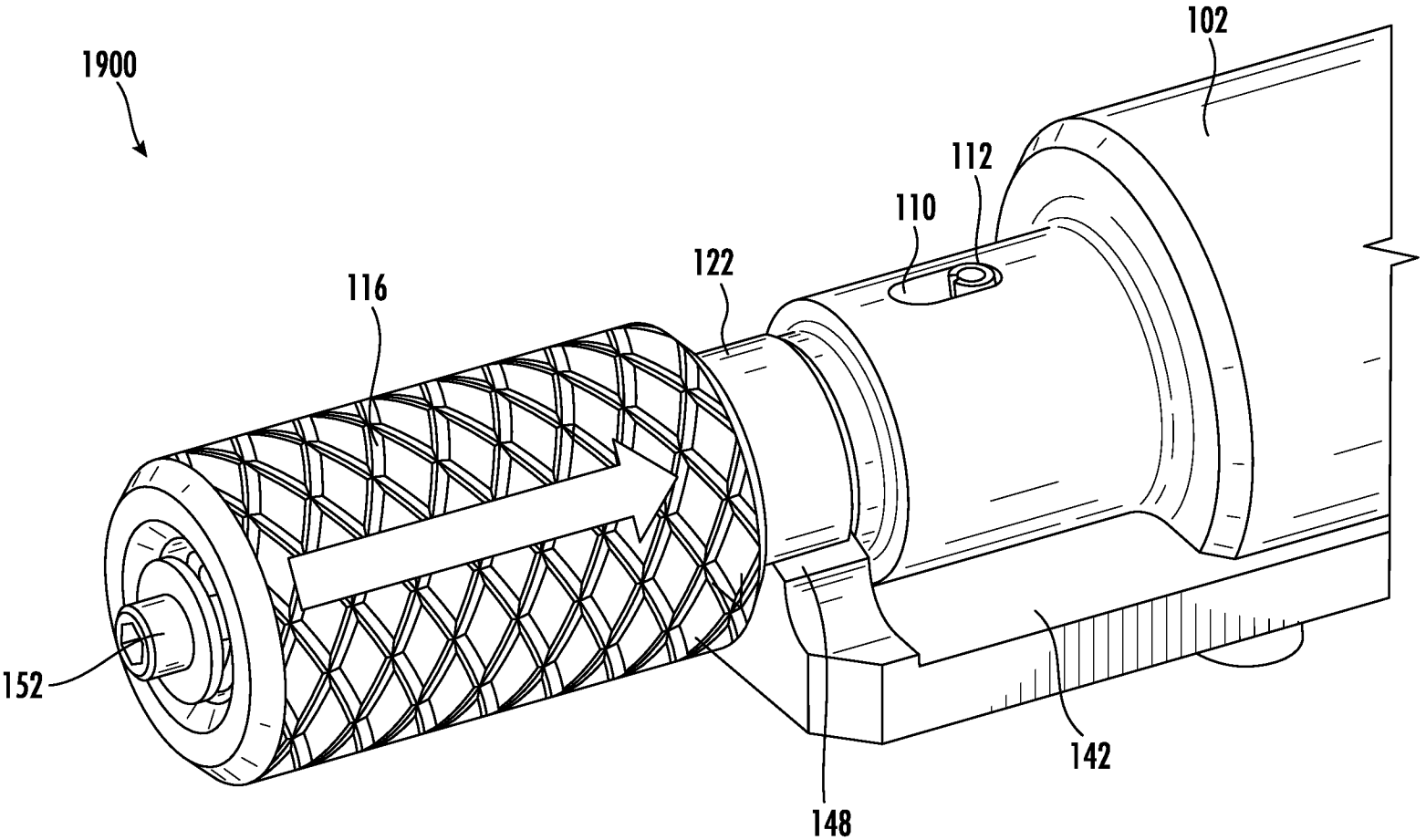
FIG. 22 illustrates an example high production tool for wire forming undergoing the method illustrated in FIG. 19 in accordance with one or more embodiments of the present disclosure.

As shown in block 1920 of FIG. 19, the method of producing a formed wire may include rotating the second anvil from a first position to a second position to transform the wire into a curved wire. As described above, in some embodiments, actuating the second anvil may include rotating the second anvil (e.g., around the mandrel) from a first position, such as depicted in FIG. 20, to a second position, such as depicted in FIG. 21. In some embodiments, the second anvil may be configured to rotate a quarter turn (e.g., the second anvil may be rotated by 90 degrees). In some embodiments, the knob of the second anvil may be in contact with the stopper of the plate when the second anvil is in the second position. In this regard, the stopper may be configured to at least partially cause the second anvil to rotate by a quarter turn (e.g., the stopper prevents the second anvil from rotating more than a quarter turn). In some embodiments, the curved wire may include a u-shaped portion.

As shown in block 1930 of FIG. 19, the method of producing a formed wire may include pushing the second anvil towards the first anvil to transform the curved wire into the formed wire. As described above, the second anvil and the mandrel are pushed towards the first anvil, the knob protrusion may enter the indent of the first anvil. As the knob protrusion enters the indent, a first portion of the curved wire is pushed by the knob protrusion into the indent while a second portion of the curved wire remains outside the indent causing a bend to form in the curved wire. The second anvil and the mandrel may be pushed towards the first anvil until the knob contacts the first anvil (e.g., the knob contacts the first end) to create the formed wire, such as depicted in FIG. 11 (e.g., when the knob contacts the first end the curved wire has been bent to form the elbow-shaped portion of the formed wire).

As shown in block 1940 of FIG. 19, the method of producing a formed wire may optionally include retracting the second anvil away from the first anvil.

As shown in block 1950 of FIG. 19, the method of producing a formed wire may optionally include removing the formed wire from the recess of the mandrel. As described above, in some embodiments, the second anvil and the mandrel may be configured to be retracted (e.g., retracted to the place the second anvil and the mandrel were before being pushed) so that the formed wire may be removed from the high production tool for wire forming.

Example Method for of Manufacturing a Tool for Producing a Formed Wire

Figure 23:
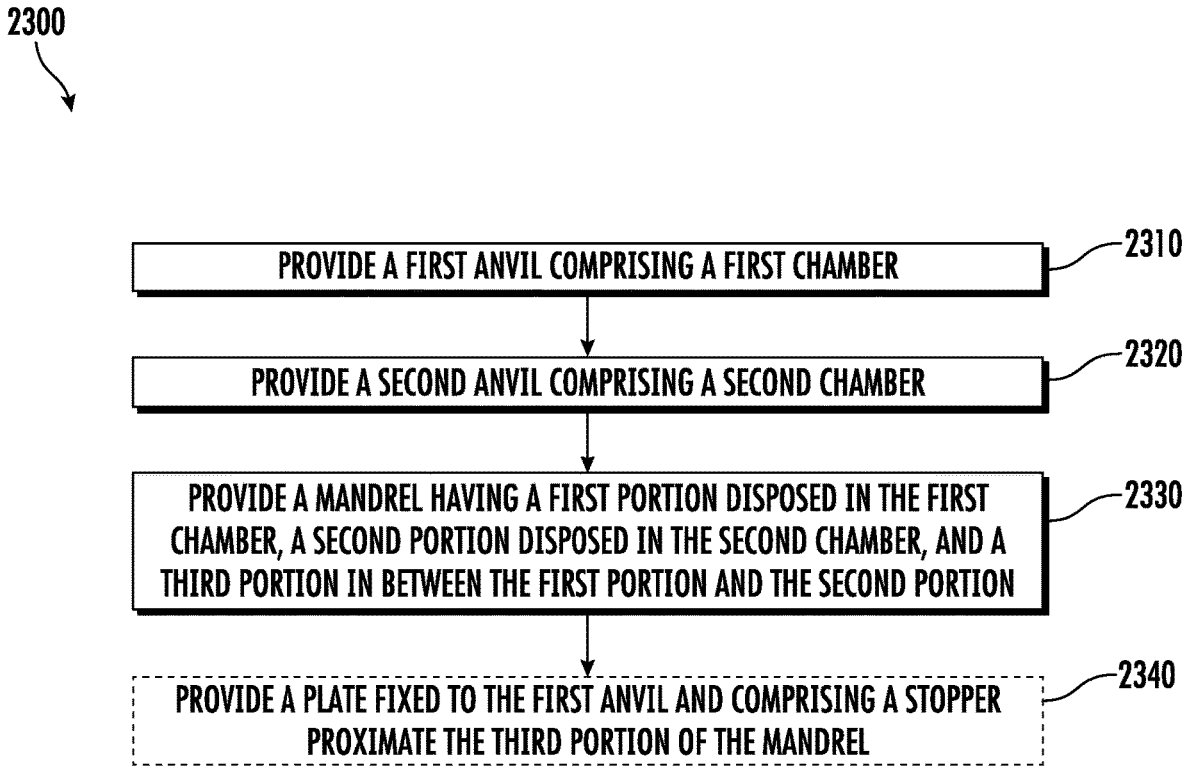
FIG. 23 illustrates a flowchart of an example method of manufacturing an example high production tool for wire forming.

Referring now to FIG. 23, a method for manufacturing a tool for producing a formed wire 2300 is illustrated.

As shown in block 2310, the method of manufacturing a tool for producing a formed wire may include providing a first anvil comprising a first chamber.

As shown in block 2320, the method of manufacturing a tool for producing a formed wire may include providing a second anvil comprising a second chamber. As described above, the second anvil may include a knob may be disposed at a first end of the second anvil and proximate the second chamber. In this regard, the knob may extend outward towards the first anvil. In some embodiments, the second anvil may include a knob protrusion. The knob protrusion may be disposed on the knob. In this regard, the knob protrusion may extend outward from the knob towards the first anvil. As described above, the second anvil may be configured to be actuated from an open position to a closed position to transform the wire into the formed wire.

As shown in block 2330, the method of manufacturing a tool for producing a formed wire may include providing a mandrel having a first portion disposed in the first chamber, a second portion disposed in the second chamber, and a third portion in between the first portion and the second portion. As described above, the mandrel may have a first portion disposed in a first chamber of a first anvil, a second portion disposed in a second chamber of a second anvil, and a third portion in between the first portion and the second portion. As described above, the third portion may have a recess configured to receive a wire. As described above, in some embodiments, actuating the second anvil may include rotating the second anvil (e.g., around the mandrel) from a first position to a second position. In some embodiments, the second anvil may be configured to rotate a quarter turn (e.g., the second anvil may be rotated by 90 degrees). In some embodiments, rotating the second anvil from the first position to the second position causes the wire to transform into a curved wire. In this regard, the curved wire may include a u-shaped portion. As described above, in some embodiments, actuating the second anvil may include pushing the second anvil and the mandrel towards the first anvil (e.g., after the second anvil has been rotated). In some embodiments, the second anvil and the mandrel may be pushed towards the first anvil until the knob contacts the first anvil (e.g., the knob contacts the first end) to create the formed wire (e.g., when the knob contacts the first end the curved wire has been bent to form the elbow-shaped portion of the formed wire).

As shown in block 2340, the method of manufacturing a tool for producing a formed wire may optionally include providing a plate fixed to the first anvil and comprising a stopper proximate the third portion of the mandrel.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

The invention claimed is:

1. A tool for producing a formed wire, the tool comprising:

a first anvil comprising a first chamber;

a second anvil comprising a second chamber; and a mandrel having a cylindrical shape, wherein the mandrel has a first portion disposed in the first chamber, a second portion disposed in the second chamber, and a third portion in between the first portion and the second portion, wherein the third portion comprises a recess configured to receive a wire, wherein the recess is in the third portion is cylindrical in shape and oriented perpendicular to a central axis of the cylindrical shape of the mandrel, wherein the second anvil is configured to be actuated from an open position to a closed position to transform the wire received into the recess into the formed wire, and wherein to actuate the second anvil from the open position to the closed position includes:

rotating the second anvil with respect to the first anvil and the mandrel; and after rotating the second anvil, pushing the second anvil towards the first anvil and over at least a portion of the third portion of the mandrel.

2. The tool of claim 1, further comprising:

a plate fixed to the first anvil and comprising a stopper proximate the third portion of the mandrel.

3. The tool of claim 2, wherein the second anvil is configured to be rotated from a first position to a second position, wherein the second anvil is in contact with the stopper when in the second position.

4. The tool of claim 3, wherein the second anvil is configured to be rotated from the first position to the second position to transform the wire into a curved wire.

5. The tool of claim 4, wherein the second anvil is configured to be pushed to towards the first anvil to transform the curved wire into the formed wire.

6. The tool of claim 1, wherein the formed wire comprises a u-shaped portion and an elbow-shaped portion.

7. The tool of claim 4, wherein the curved wire comprises a u-shaped portion.

8. A method for producing a formed wire, the method comprising:

placing a wire into a recess of a mandrel, wherein the mandrel has a cylindrical shape, wherein the mandrel has a first portion disposed in a first chamber of a first anvil, a second portion disposed in a second chamber of a second anvil, and a third portion in between the first portion and the second portion, wherein the recess is in the third portion is cylindrical in shape and oriented perpendicular to a central axis of the cylindrical shape of the mandrel;

actuating the second anvil from an open position to a closed position to transform the wire into the formed wire by:

rotating the second anvil with respect to the first anvil from a first position to a second position to transform the wire into a curved wire; and pushing, after rotating the second anvil, the second anvil towards the first anvil and over at least a portion of third portion of the mandrel, to transform the curved wire into the formed wire.

9. The method of claim 8, further comprising:

retracting the second anvil away from the first anvil; and removing the formed wire from the recess of the mandrel.

10. The method of claim 8, wherein the second anvil is in contact with a stopper when in the second position.

11. The method of claim 8, wherein the formed wire comprises a u-shaped portion and an elbow-shaped portion.

* * * * *